United States Patent [19]

Matushita et al.

[11] Patent Number: 4,966,835

[45] Date of Patent: Oct. 30, 1990

[54] METHOD FOR PROCESSING A SILVER HALIDE COLOR PHOTOGRAPHIC MATERIAL

[75] Inventors: Tetunori Matushita; Morio Yagihara; Kei Sakanoue, all of Kanagawa, Japan

[73] Assignee: Fuji Photo Film Co., Ltd., Kanagawa, Japan

[21] Appl. No.: 231,557

[22] Filed: Aug. 12, 1988

[30] Foreign Application Priority Data

Aug. 13, 1987 [JP] Japan ..... 62-202367

[51] Int. Cl.[5] ..... G03C 7/42

[52] U.S. Cl. ..... 430/393; 430/448; 430/460; 430/505; 430/566; 430/955; 430/957; 430/963

[58] Field of Search ..... 430/393, 430, 448, 505, 430/566, 599, 600, 955, 957, 963

[56] References Cited

U.S. PATENT DOCUMENTS 4,264,721 4/1981 Shimano et al. ..... 430/963
4,659,651 4/1987 Yagihara et al. ..... 430/957
4,690,885 9/1987 Yagihara et al. ..... 430/957
4,764,455 8/1988 Arakawa et al. ..... 430/460

*Primary Examiner*—Paul R. Michl
*Assistant Examiner*—Hoa Van Le
*Attorney, Agent, or Firm*—Sughrue, Mion, Zinn, Macpeak & Seas

[57] ABSTRACT

A method for processing a silver halide color photographic material is described, comprising a support having thereon at least one of a silver halide emulsion layer and other hydrophilic colloid layer, wherein the silver halide emulsion layer or other hydrophilic colloid layer contains at least one compound represented by formula (I):

A—B (I)

wherein A represents a blocking group capable of being cleaved from B during processing and B represents a bleach accelerating agent containing at least one hetero atom linked to A through the hetero atom, wherein said method comprises at least one color developing step and desilvering step comprising a bleach-fixing treatment.

11 Claims, No Drawings

METHOD FOR PROCESSING A SILVER HALIDE COLOR PHOTOGRAPHIC MATERIAL

FIELD OF THE INVENTION

The present invention relates to a method for processing a silver halide color photographic material, and more particularly, to a method for processing a silver halide color photographic material containing a compound in which an active group or an adsorptive group of a bleach accelerating agent is blocked.

BACKGROUND OF THE INVENTION

The fundamental steps of processing color photographic light-sensitive materials generally include a color developing step and a silver removing step (i.e., desilvering step). Thus, an exposed silver halide color photographic material is introduced into a color developing step, where silver halide is reduced with a color developing agent to produce silver and the oxidized color developing agent in turn reacts with a color former to yield a dye image. Subsequently, the color photographic material is introduced into a silver removing step, where silver produced in the preceding step is oxidized with an oxidizing agent (usually called a bleaching agent), and dissolved away with a silver ion complexing agent usually called a fixing agent. Therefore, only a dye image is formed in the thus processed photographic material. In addition to the above described two fundamental steps of color development and silver removal (i.e., desilvering), actual development processing involves auxiliary steps for maintaining the photographic and physical quality of the resulting image or for improving the preservability of the image. For example, such processes include a hardening bath for preventing a light-sensitive layer from being excessively softened during photographic processing, a stopping bath for effectively stopping the developing reaction, an image stabilizing bath for stabilizing the image, and a layer removing bath for removing the backing layer on the support.

The above described silver removal step may be conducted in two ways: one uses two steps employing a bleaching bath and a fixing bath; and the other is more simple and is conducted in one step employing a bleach-fixing bath containing both a bleaching agent and a fixing agent for the purpose of accelerating the processing and labor elimination. In view of the acceleration and simplification of the processing, the bleach-fixing bath is preferred.

Bleach processing using a ferric ion complex salt (for example, an aminopolycarboxylic acid-ferric ion complex salt, particularly iron (III) ethylenediaminetetraacetate complex salt) as a major bleach bath component has mainly been employed in processing color photographic light-sensitive materials in view of the acceleration and simplification of the bleaching provided and the need to prevent environmental pollution.

However, ferric ion complex salts have a comparatively low oxidizing power and, therefore, have insufficient bleaching ability.

In order to raise the bleaching ability of a bleaching solution or a bleach-fixing solution containing a ferric ion complex salt such as iron (III) ethylenediaminetetraacetate as a bleaching agent, it has been proposed to add various bleach accelerating agents to the processing bath.

Examples of such bleach accelerating agents include 5-membered heterocyclic mercapto compounds as described in British Patent No. 1,138,842, thiadiazole derivatives thiourea derivatives, and thiazole derivatives, as described in Swiss Patent No. 336,257, etc. However, these compounds do not necessarily have sufficient bleach accelerating effects when they are added to a bleaching solution or a prebath thereof. Also, insufficient bleach accelerating effects are obtained when they are added to a bleach-fixing solution or a prebath thereof. Further, in the latter case they react with silver ions present in the bleach-fixing solution to form a precipitate which is troublesome. For example, the precipitate can block filters of a circulation system in an automatic processing machine and it adheres to photographic light-sensitive materials, resulting in stain formation.

A processing method is also known wherein a 5-membered heterocyclic compound containing two or three nitrogen atoms as ring constituting members and having at least one mercapto group is added to a bath just before a bath for the bleaching processing as described in JP-A-No. 54-52534 (the term "JP-A" as used herein means an "unexamined published Japanese patent application"). However, when these compounds are directly added to a bleaching solution or a bleach-fixing solution, sufficient bleach accelerating effects cannot be obtained. In addition, they lack stability in the processing solution and cannot endure use for a long period of time.

Furthermore, heterocyclic alkylmercaptan derivatives as described in JP-A-No. 53-32736, disulfide compounds as described in JP-A-No. 53-95630, isothiourea derivatives as described in *Research Disclosure,* No. 15704 (May, 1977), and aminoalkylmercaptan derivatives as described in U.S. Pat. No. 3,893,858 are known as bleach accelerating agents. However, these bleach accelerating agents have various disadvantages, although some of them show a satisfactory bleach accelerating effect. More specifically, when these compounds are added to a bleaching solution and color photographic materials are continuously processed using such a bleaching solution, precipitate occurs in the bleaching solution, which causes many difficulties. The precipitate clogs filters of a circulation system in an automatic processing machine and adheres to photographic light-sensitive materials, resulting in stain formation. Further, it is also known that the bleach accelerating effect is reduced under a running condition. This is believed to be due to the fact that thiol or disulfide is converted to a thiolsulfonate ion by a sulfite ion which is carried over from a developing solution into a bleaching solution and thus loses its adsorbability to developed silver.

Therefore, in order to effectively accelerate silver removal, it has been proposed to incorporate such a bleach accelerating agent into a silver halide color photographic material instead of adding the compound to a processing bath such as a bleaching bath or a bleach-fixing bath. However, many compounds which are generally designated bleach accelerating agents may form undesired fog when they are directly incorporated into color photographic light-sensitive materials. Moreover, they sometime cause a decrease in sensitivity and a change in photographic characteristics (such as sensitivity, gradation, fog, etc.) of the photographic light-sensitive material during preservation and cannot be practically employed.

Many attempts have been made to overcome such problems as fog formation caused by the incorporation of bleach accelerating agents into a color photographic light-sensitive material and to further increase the bleach accelerating effect. For instance, there is a method of using a bleach accelerating agent in the form of a salt (for example, a silver salt, etc.) with a heavy metal ion as described in JP-A-No. 53-134430, JP-A-No. 53-147529 and JP-A-No. 55-64237. However, this method does not provide a sufficient bleach accelerating effect. Also, methods utilizing a bleach accelerator releasing coupler are described in *Research Disclosure,* No. 11449 (1973) and JP-A-No. 61-201247. However, these known bleach accelerator releasing couplers can only release bleach accelerating agents at the time of color development and do not release them at the time of bleaching or bleach-fixing, and thus their bleach accelerating effects are still unsatisfactory. Also, they may hinder the color forming reaction in some cases. Further improvement, accordingly, has been desired.

SUMMARY OF THE INVENTION

An object of the present invention is, therefore, to provide a method for processing a silver halide color photographic material, which achives stabilization of a processing solution, and acceleration and simplification of processing.

Another object of the present invention is to provide a method for processing a silver halide color photographic material, in which the bleach accelerating function is maintained even under running conditions.

A further object of the present invention is to provide a method for processing a silver halide color photographic material, which has a high bleaching rate and is capable of being used for rapid processing.

Other objects of the present invention will become apparent from the following description and examples.

It has now been discovered that these and other objects of the present invention are attained by a method for processing a silver halide color photographic material comprising a support having thereon at least one of a silver halide emulsion layer and other hydrophilic colloid layer, wherein the silver halide emulsion layer or other hydrophilic colloid layer contains at least one compound represented by formula (I):

$$A—B \qquad (I)$$

wherein A represents a blocking group capable of being cleaved from B during processing and B represents a bleach accelerating agent containing at least one hetero atom linked to A through the hetero atom, wherein said method comprises at least one color developing step and desilvering step comprising a bleach-fixing treatment.

DETAILED DESCRIPTION OF THE INVENTION

The compound represented by formula (I) is described in greater detail below.

The blocking group represented by A is capable of being cleaved from B during the processing (e.g., a developing, a bleaching, a fixing or a bleach-fixing) to release the bleach accelerating agent represented by B.

The blocking group represented by A includes any conventional blocking group known in the art For example, these include a blocking group such as an acyl group or a sulfonyl group, as described in JP-B-No. 48-9968, (the term "JP-B" as used herein means an "examined Japanese patent publication") JP-A-No. 52-8828 and JP-A-No. 57-82834, U.S. Pat. No. 3,311,476, and JP-B-No. 47-44805 (U.S. Pat. No. 3,615,617); a blocking group utilizing a reverse Michael reaction as described in JP-B-No. 55-17369 (U.S. Pat. No. 3,888,677), JP-B-No. 55-9696 (U.S. Pat. No. 3,791,830) and JP-B-No. 55-34927 (U.S. Pat. No. 4,009,029), JP-A-No. 56-77842 (U.S. Pat. No. 4,307,175), and JP-A-No. 59-105642 and JP-A-No. 59-105640; a blocking group utilizing the formation of a quinonemethide or quinonemethide-like compound by intramolecular electron transfer as described in JP-B-No. 54-39727, U.S. Pat. Nos. 3,674,478, 3,932,480 and 3,993,661, and JP-A-No. 57-135944, JP-A-No. 57-135945 and JP-A-No. 57-136640; a blocking group utilizing an intramolecular ring closing reaction as described in JP-A-No. 55-53330 and JP-A-No. 59-218439; a blocking group utilizing the cleavage of a 5-membered or 6-membered ring as described in JP-A-No. 57-76541 (U.S. Pat. No. 4,335,200), and JP-A-No. 57-135949, JP-A-No. 57-179842, JP-A-No. 59-137945, JP-A-No. 59-140445, JP-A-No. 59-219741 and JP-A-No. 60-41034; and a blocking group utilizing the addition of a nucleophilic reagent to the unsaturated bond as described in JP-A-Nos. 59-201057, 61-43739 and 61-95347.

Among the compounds represented by formula (I), preferred compounds are represented by formula (II):

$$A\text{-}(X_1)_{m_1}\text{-}D$$

wherein A has the same meaning as in formula (I); a $\text{-}(X_1)_{m_1}\text{-}D$ moiety in formula (II) represents a moiety B in formula (I); D represents a bleach accelerating agent containing at least one hetero atom and linked to $X_1$ or A through the hetero atom; $X_1$ represents a divalent linking group containing at least one hetero atom and linked to A through the hetero atom; and $m_1$ is 0 or 1.

The bleach accelerating agent represented by D in formula (II) has a bleach accelerating effect by itself and, when it is incorporated into a color photographic light-sensitive material, it may form undesired fog, cause a decrease in sensitivity and a change in photographic characteristics (such as sensitivity, gradation, fog, etc.) of the color photographic light-sensitive material during preservation thereof, D also contains a hetero atom though which D may be connected directly to A (when $m_1$ is 0) or may be connected to A via $X_1$ (when $m_1$ is 1), and is capable of being released from A or $X_1$ upon photographic processing, for example, development, bleaching, fixing, bleach-fixing. More specifically, D is represented by the following formulae (III) or (III'):

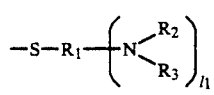

(III)

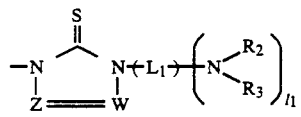

(III')

wherein $R_1$ represents a divalent, trivalent or tetravalent aliphatic group having from 1 to 8 carbon atoms,

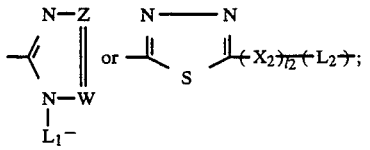

Z and W which may be the same or different, each represents

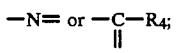

$R_4$ represents a hydrogen atom, a halogen atom, an amino group, a hydroxyl group, an alkenyl group (preferably having 1 to 20 carbon atoms), an aryl group (preferably having 6 to 20 carbon atoms) or an aralkyl group (preferably having 1 to 20 carbon atoms); $l_1$ is 0, 1, 2, or 3; $L_1$ represents a hydrogen atom when $l_1$ is 0 and $L_1$ represents a divalent, trivalent or tetravalent aliphatic group having from 1 to 8 carbon atoms when $l_1$ is 1, 2 or 3; $L_2$ represents a divalent, trivalent or tetravalent aliphatic group having from 1 to 8 carbon atoms; $X_2$ represents

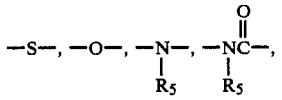

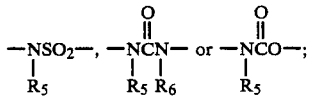

wherein $R_5$ and $R_6$, which may be the same or different, each represents a hydrogen atom or a lower alkyl group (preferably having 1 to 8 carbon atoms); $l_2$ is 0 or 1; $R_2$ and $R_3$, which may be the same or different, each represents a hydrogen atom, an alkyl group and an acyl group, or $R_2$ and $R_3$ may be linked to form a nitrogen-containing heterocyclic ring.

$X_1$ in formula (II) represents a divalent linking group, which contains a hetero atom linked to A. The bond between $X_1$ and A is cleaved during the photographic processing (for example, development, bleaching, fixing, bleach-fixing, to release $X_1$—D, and $X_1$—D promptly releases bleach accelerating agent D.

Specific examples of the linking group $X_1$ include one which releases D upon an intramolecular ring-closing reaction, as described in JP-A-No. 54-145135 (UK-A-No. 2,010,818), U.S. Pat. Nos. 4,248,962 and 4,409,323, and British Patent No. 2,096,783; one which releases D through intramolecular electron transfer, as described in British Patent No. 2,072,363, JP-A-No. 57-154234; one which releases D with the elimination of carbon dioxide, as described in JP-A-No. 57-179842; and one which releases D with the elimination of formaldehyde, as described in JP-A-No. 59-93422.

Structural formulae of typical examples of $X_1$ are illustrated (together with D) below but the present invention is not to be construed as being limited thereto.

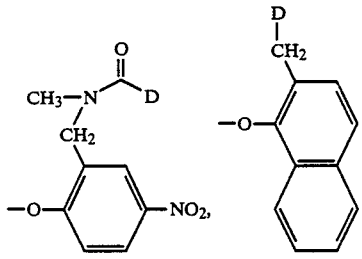

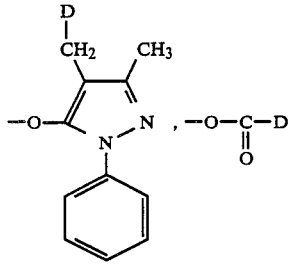

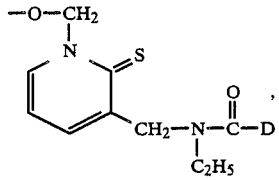

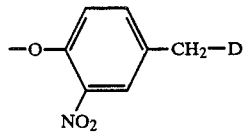

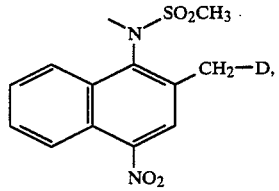

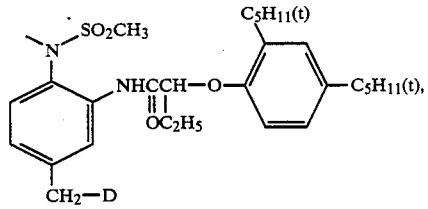

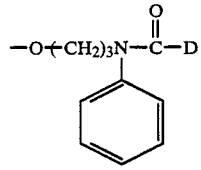

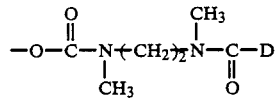

-continued

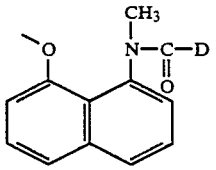

$X_1$ may be selected for use depending upon the timing for releasing D, the control of the release and the kind of D used.

Preferred blocked bleach accelerating agents used in the present invention are compounds which have at least one functional group selected from

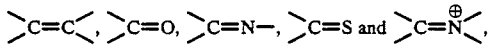

and release a bleach accelerating agent upon the attack of a nucleophilic substance (representative examples thereof include an $OH^-$ ion and $SO_3^{2-}$ ion) on the carbon atom of the above functional group and subsequent reaction.

Of these compounds (i.e., blocked bleach accelerating agents), particularly preferred compounds are represented by formula (IV):

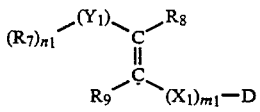

(IV)

wherein $R_7$, $R_8$ and $R_9$, which may be the same or different, each represents a hydrogen atom or a group that can be substituted, provided that $R_7$ and $R_8$ or $R_7$ and $R_9$ may be linked to form a carbocyclic ring or a heterocyclic ring; n, is 0 or 1; $Y_1$ represents

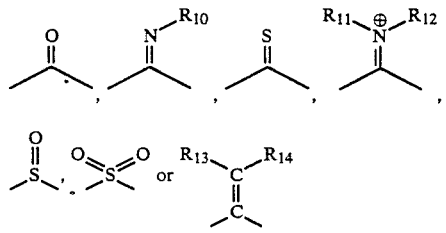

a cyano group or a nitro group when n is 0; $R_{10}$, $R_{11}$, $R_{12}$, $R_{13}$ and $R_{14}$, which may be the same or different, each represents a hydrogen atom or a group that can be substituted; and $X_1$, $m_1$ and D each has the same meaning as in formula (II).

The compound represented by formula (IV) is able to release a bleach accelerating agent represented by D upon photographic processing (for example, development, bleaching, fixing, bleach-fixing, etc.) upon the addition of a nucleophilic reagent (for example, $OH^-$ ion, $SO_3^{2-}$ ion, hydroxylamine) contained in the processing solution to the unsaturated bond present therein.

In order to block the active group which is released by the addition of a nucleophilic reagent to the unsaturated bond, the methods as described in JP-A-No. 59-201057, JP-A-No. 61-43739 and JP-A-No. 61-95347 can be employed.

The compound represented by formula (IV) is described in greater detail below.

$R_7$ in formula (IV) represents a hydrogen atom or a group that can be substituted. Suitable examples of the group that can be substituted include an alkyl group (preferably having from 1 to 20 carbon atoms), an alkenyl group (preferably having from 2 to 20 carbon atoms), an aryl group (preferably having from 6 to 20 carbon atoms), an alkoxy group (preferably having from 1 to 20 carbon atoms), an aryloxy group (preferably having from 6 to 20 carbon atoms), an alkylthio group (preferably having from 1 to 20 carbon atoms), an arylthio group (preferably having from 6 to 20 carbon atoms), an amino group (including an unsubstituted amino group and preferably a secondary or tertiary amino group substituted with an alkyl group having from 1 to 20 carbon atoms or an aryl group having from 6 to 20 carbon atoms), or a hydroxyl group. The group that can be substituted represented by $R_7$ may have one or more substituents described below. When two or more substituents are present, they may be the same or different. Specific examples of the substituents include a halogen atom (for example, fluorine, chlorine, bromine), an alkyl group (preferably having from 1 to 20 carbon atoms), an aryl group (preferably having from 6 to 20 carbon atoms), an alkoxy group (preferably having from 1 to 20 carbon atoms), an aryloxy group (preferably having from 6 to 20 carbon atoms), an alkylthio group (preferably having from 1 to 20 carbon atoms), an arylthio group (preferably having from 6 to 20 carbon atoms), an acyl group (preferably having from 2 to 20 carbon atoms), an acylamino group (preferably an alkanoylamino group having from 1 to 20 carbon atoms or a benzoylamino group having from 6 to 20 carbon atoms), a nitro group, a cyano group, an oxycarbonyl group (preferably an alkoxycarbonyl group having from 1 to 20 carbon atoms or an aryloxycarbonyl group having from 6 to 20 carbon atoms), a hydroxyl group, a carboxyl group, a sulfo group, a ureido group (preferably an alkylureido group having from 1 to 20 carbon atoms or an arylureido group having from 6 to 20 carbon atoms), a sulfonamide group (preferably an alkylsulfonamide group having from 1 to 20 carbon atoms or an arylsulfonamide group having from 6 to 20 carbon atoms), a sulfamoyl group (preferably an alkylsulfamoyl group having from 1 to 20 carbon atoms or an arylsulfamoyl group having from 6 to 20 carbon atoms), a carbamoyl group (preferably an alkylcarbamoyl group having from 1 to 20 carbon atoms or an arylcarbamoyl group having from 6 to 20 carbon atoms), an acyloxy group (preferably having from 1 to 20 carbon atoms), an amino group (including an unsubstituted amino group and preferably a secondary or tertiary amino group substituted with an alkyl group having from 1 to 20 carbon atoms or an aryl group having from 6 to 20 carbon atoms), a carbonic acid ester group (preferably an alkyl carbonic acid ester having from 1 to 20 carbon atoms or an aryl carbonic acid ester having from 6 to 20 carbon atoms), a sulfone group (preferably an alkylsulfone group having from 1 to 20 carbon atoms or an arylsulfone group having from 6 to 20 carbon atoms), and a sulfinyl group (preferably an alkylsulfinyl group having from 1 to 20 carbon atoms or an arylsulfinyl group having from 6 to 20 carbon atoms). Among these, a halogen atom and an alkyl group having 3 to 20 carbon atoms are preferred.

Further, $R_7$ may combine with $R_8$ or $R_9$ to form a carbocyclic ring or a heterocyclic ring (for example, a 5-membered, 6-membered or 7-membered ring).

$R_8$ and $R_9$ in formula (IV) may be the same or different and each represents a hydrogen atom or a group that can be substituted. Specific examples of the group that can be substituted include a halogen atom (for example, fluorine, chlorine, bromine), an alkyl group (preferably having from 1 to 20 carbon atoms), an aryl group (preferably having from 6 to 20 carbon atoms), an alkoxy group (preferably having from 1 to 20 carbon atoms), an aryloxy group (preferably having from 6 to 20 carbon atoms), an alkylthio group (preferably having from 1 to 20 carbon atoms), an arylthio group (preferably having from 6 to 20 carbon atoms), an acyloxy group (preferably having from 2 to 20 carbon atoms), an amino group (including an unsubstituted amino group and preferably a secondary or tertiary amino group substituted with an alkyl group having from 1 to 20 carbon atoms or an aryl group having from 6 to 20 carbon atoms), a carbonamide group (preferably an alkylcarbonamide group having from 1 to 20 carbon atoms or an arylcarbonamide group having from 6 to 20 carbon atoms), a ureido group (preferably an alkylureido group having from 1 to 20 carbon atoms or an arylureido group having from 6 to 20 carbon atoms), a carboxyl group, a carbonic acid ester group (preferably an alkyl carbonic acid ester having from 1 to 20 carbon atoms or an aryl carbonic acid ester having from 6 to 20 carbon atoms), an oxycarbonyl group (preferably an alkoxycarbonyl group having from 1 to 20 carbon atoms or an aryloxycarbonyl group having from 6 to 20 carbon atoms), a carbamoyl group (preferably an alkylcarbamoyl group having from 1 to 20 carbon atoms or an arylcarbamoyl group having from 6 to 20 carbon atoms), an acyl group (preferably an alkylcarbonyl group having from 1 to 20 carbon atoms or an arylcarbonyl group having from 6 to 20 carbon atoms), a sulfo group, a sulfonyl group (preferably an alkylsulfonyl group having from 1 to 20 carbon atoms or an arylsulfonyl group having from 6 to 20 carbon atoms), a sulfinyl group (preferably an alkylsulfinyl group having from 1 to 20 carbon atoms or an arylsulfinyl group having from 6 to 20 carbon atoms), a sulfamoyl group (preferably an alkylsulfamoyl group having from 1 to 20 carbon atoms or an arylsulfamoyl group having from 6 to 20 carbon atoms), a cyano group or a nitro group. The group that can be substituted represented by $R_8$ or $R_9$ may have one or more substituents. When two or more substituents are present, they may be the same or different. Specific examples of the substituents include those described for $R_7$ above.

In formula (IV), when $n_1$ is 1, $Y_1$ represents

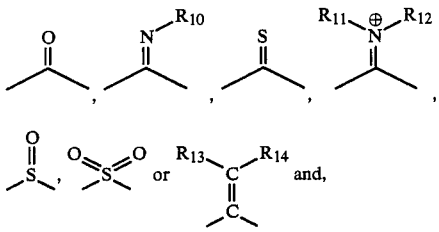

when $n_1$ represents 0, $Y_1$ represents a cyano group or a nitro group; and $R_{10}$, $R_{11}$, $R_{12}$, $R_{13}$ and $R_{14}$, which may be the same or different, each represents a hydrogen atom or a group that can be substituted. Specific examples of the group that can be substituted represented by $R_{10}$, $R_{11}$, $R_{12}$, $R_{13}$ and $R_{14}$ include an alkyl group (preferably having from 1 to 20 carbon atoms), an alkenyl group (preferably having from 2 to 20 carbon atoms), an aryl group (preferably having from 6 to 20 carbon atoms), an alkoxy group (preferably having from 1 to 20 carbon atoms), an aryloxy group (preferably having from 6 to 20 carbon atoms), an acyloxy group (preferably having from 2 to 20 carbon atoms), an amino group (including an unsubstituted amino group and preferably a secondary or tertiary amino group substituted with an alkyl group having from 1 to 20 carbon atoms or an aryl group having from 6 to 26 carbon atoms), a carbonamide group (preferably an alkylcarbonamine group having from 1 to 20 carbon atoms or an arylcarbonamide group having from 6 to 20 carbon atoms), a ureido group (preferably an alkylureido group having from 1 to 20 carbon atoms or an arylureido group having from 6 to 20 carbon atoms), an oxycarbonyl group (preferably an alkyloxycarbonyl group having from 1 to 20 carbon atoms or an aryloxycarbonyl group having from 6 to 20 carbon atoms), a carbamoyl group (preferably an alkylcarbamoyl group having from 1 to 20 carbon atoms or an arylcarbamoyl group having from 6 to 20 carbon atoms), an acyl group (preferably an alkylcarbonyl group having from 1 to 20 carbon atoms or an arylcarbonyl group having from 6 to 20 carbon atoms), a sulfonyl group (preferably an alkylsulfonyl group having from 1 to 20 carbon atoms or an arylsulfonyl group having from 6 to 20 carbon atoms), a sulfinyl group (preferably an alkylsulfinyl group having from 1 to 20 carbon atoms or an arylsulfinyl group having from 6 to 20 carbon atoms), a sulfamoyl group (preferably an alkylsulfamoyl group having from 1 to 20 carbon atoms or an arylsulfamoyl group having from 6 to 20 carbon atoms), a cyano group or a nitro group. Among them, preferred group that can be substituted represented by $R_{13}$ or $R_{14}$ include an oxycarbonyl group, a carbamoyl group, an acyl group, a sulfonyl group, a sulfamoyl group, a sulfinyl group, a cyano group and a nitro group.

The group that can be substituted represented by $R_{10}$, $R_{11}$, $R_{12}$, $R_{13}$, or $R_{14}$ may have one or more substituents. They may be the same or different, when two or more substituents are present. Specific examples of the substituents include those as described for $R_7$ above.

In the bleach accelerating agent represented by D, the divalent, trivalent or tetravalent aliphatic group having from 1 to 8 carbon atoms represented by $R_1$, $L_1$ or $L_2$ may be saturated or unsaturated, or straight chain, branched chain or cyclic. Representative examples thereof are shown below, but the present invention is not to be construed as being limited thereto:

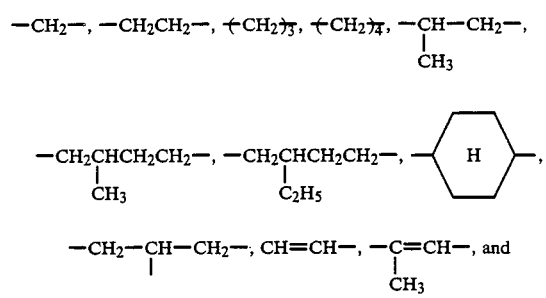

-continued $$-CH_2-CH=CH-.$$

In formula (III) or (III') above, the alkyl group represented by $R_2$ or $R_3$ may be substituted or unsubstituted and preferably has from 1 to 5 carbon atoms in the alkyl moiety (for example, methyl, ethyl, propyl). Suitable examples of the substituents for the alkyl group include a halogen atom (for example, chlorine, bromine), a hydroxyl group, an alkoxy group (for example, methoxy, ethoxy), a sulfonyl group (for example, methanesulfonyl, ethanesulfonyl), a carbamoyl group, a sulfamoyl group, a carboxyl group, a sulfo group, an amino group (for example, acetylamino) and a sulfonamide group (for example, methanesulfonamide group). Suitable examples of the heterocyclic ring which is formed by combination of $R_2$ and $R_3$ include a pyrrole ring, an imidazole ring, a pyrazole ring, a piperidine ring, a pyrrolidine ring, a piperazine ring and a morpholine ring.

The acyl group represented by $R_2$ or $R_3$ is preferably an acyl group having not more than 8 carbon atoms. Specific examples thereof include a methoxycarbonyl group, an acetyl group and a benzoyl group.

When $L_1$ represents a hydrogen atom, $l_1$ is 0, and when $L_1$ represents a divalent, trivalent or tetravalent aliphatic group having from 1 to 8 carbon atoms, $l_1$ is 1, 2 or 3, respectively.

Of the compounds represented by formula (IV), those represented by formula (V) or (VI) described below are preferred.

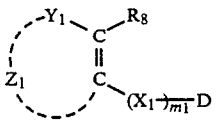

(V)

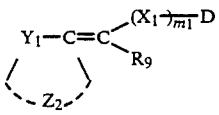

(VI)

wherein $Z_1$ and $Z_2$, which may be the same or different, each represents an atomic group necessary for forming a carbocyclic ring or a heterocyclic ring; and $R_8$ $R_9$, $X_1$, $Y_1$, D and $m_1$ each has the same meaning as in formula (IV).

The ring formed by $Z_1$ includes, for example, a 5-membered, 6-membered or 7-membered carbocyclic ring, a 5-membered, 6-membered or 7-membered heterocyclic ring containing one or more nitrogen atoms, oxygen atoms or sulfur atoms or a condensed ring containing the carbocyclic ring or heterocyclic ring. Specific examples of the ring formed by $Z_1$ include cyclopentenone, cyclohexenone, cycloheptenone, benzocycloheptenone, benzocyclopentenone, benzocyclohexenone, 4-pyridone, 4-quinolone, 2-pyrone, 4-pyrone, 1-thio-2-pyrone, 1-thio-4-pyrone, coumarin, chromone, uracil, 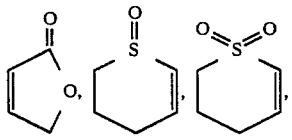

-continued

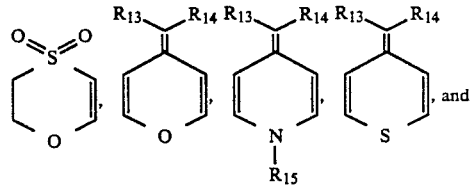

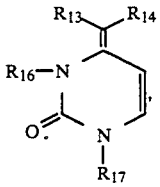

wherein $R_{13}$ and $R_{14}$ each has the same meaning as in formula (IV), and $R_{15}$, $R_{16}$ and $R_{17}$, which may be the same or different, each represents hydrogen, an alkyl group, an alkenyl group, an aryl group, an aralkyl group or an acyl group. Among these, cyclopentenone, cyclohexenone, and uracil are preferred.

The carbocyclic ring or heterocyclic ring may be substituted with one or more substituents, and when two or more substituents are present they may be the same or different. Specific examples of the substituents include those described for $R_7$ above.

The ring formed by $Z_2$ includes the rings formed by $Z_1$. Specific examples of the ring formed by $Z_2$ include cylopentanone, cyclohexanone, cycloheptanone, benzocycloheptanone, benzocyclopentanone, benzocyclohexanone, 4-tetrahydropyridone, 4-dihydroquinolone and 4-tetrahydropyrone. Among these, cyclopentanone and cyclohexanone are preferred.

The carbocyclic ring or heterocyclic ring may be substituted one or more substituents, and when two or more substituents are present they may be the same or different. Specific examples of the substituents include those as described for $R_7$ above.

In formula (IV), $R_7$, $R_8$, $R_9$, $R_{10}$, $R_{11}$, $R_{12}$, $R_{13}$ and $R_{14}$ are selected depending upon the pH value and the composition of the processing solution to be used for processing the photographic material in which the compound represented by formula (IV) according to the present invention is incorporated, and upon the time required for timing.

In addition to selection of pH of the processing solution (for example, development, fixing, etc.), it is possible to control the releasing rate of the bleach accelerating agent over a wide range by using a nucleophilic substance, especially a sulfite ion, hydroxylamine, a thiosulfate ion, a metabisulfite ion, a hydroxamic acid or similar compound as described in JP-A-No. 59-198453, an oxime compound as described in JP-A-No. 60-35729, or a dihydroxybenzene type developing agent, a 1-phenyl-3-pyrazolidone type developing agent, or a paminophenol type developing agent, each described hereinafter.

The amount of such a nucleophilic substance added is usually from about 1 to about $10^8$ times by mol, preferably from about $10^2$ to about $10^6$ times by mol of the compound according to the present invention.

Specific examples of the compounds according to the present invention are set forth below, but the present invention is not to be construed as being limited thereto.

(1)
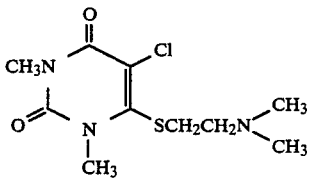
(2)
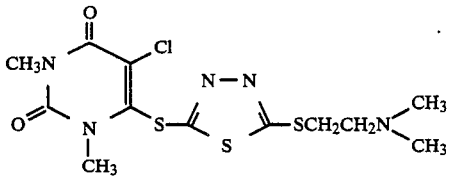
(3)
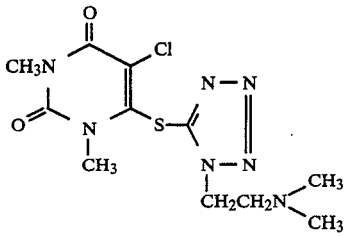
(4)
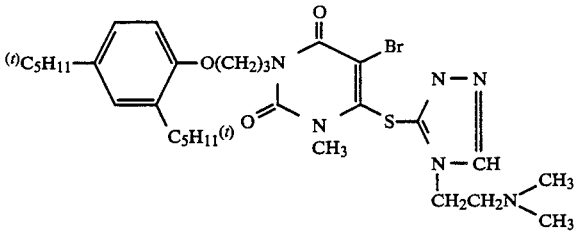
(5)
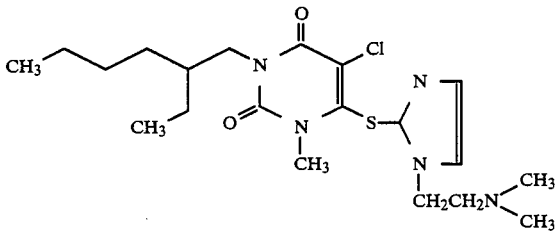
(6)
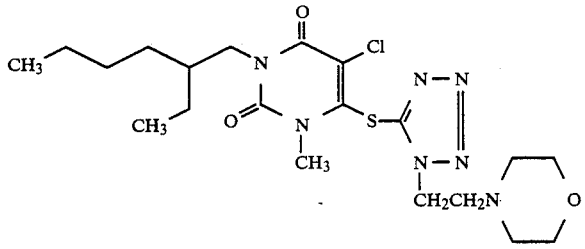
(7)
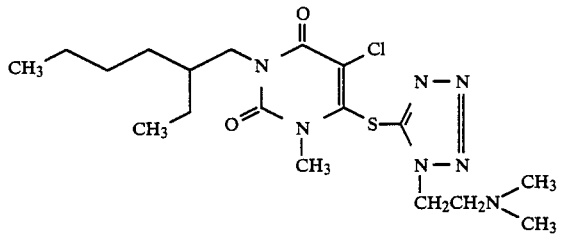

-continued
(8)
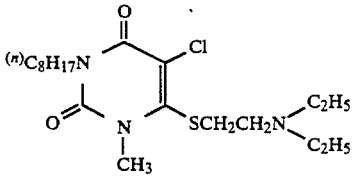
(9)
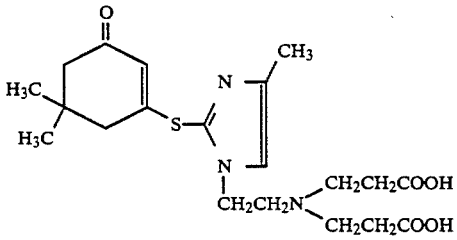
(10)
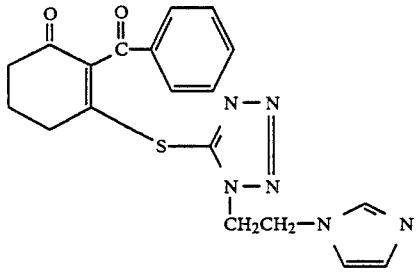
(11)
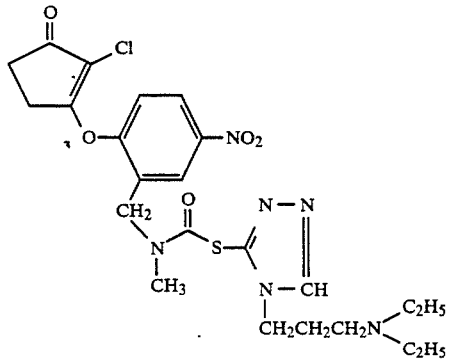
(12)
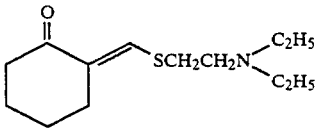
(13)
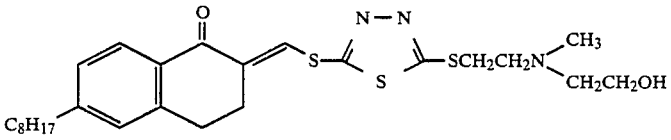
(14)
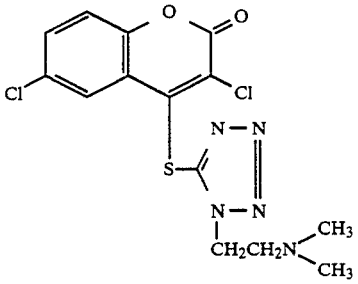

-continued
(15)
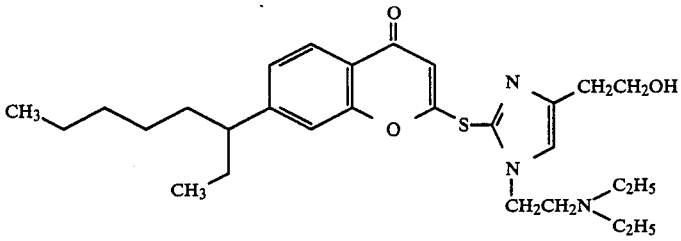
(16)
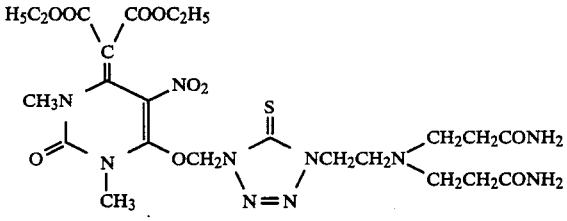
(17)
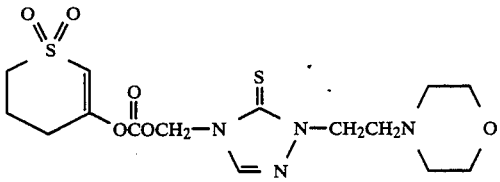
(18)
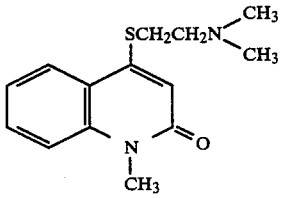
(19)
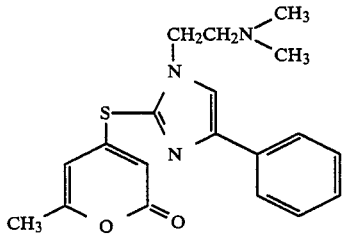
(20)
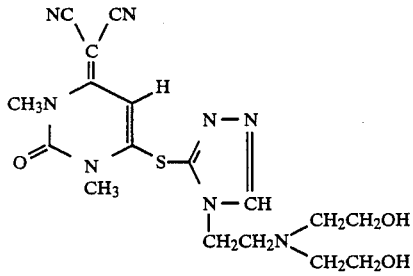
(21)
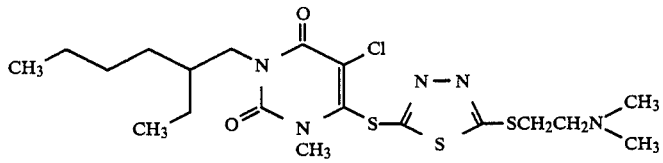

-continued
(22)
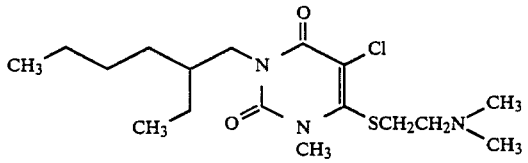
(23)
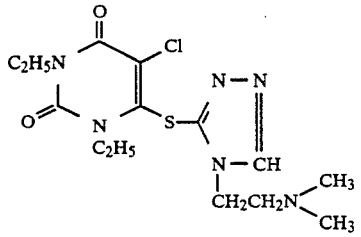
(24)
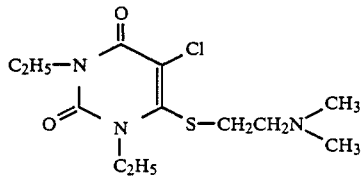
(25)
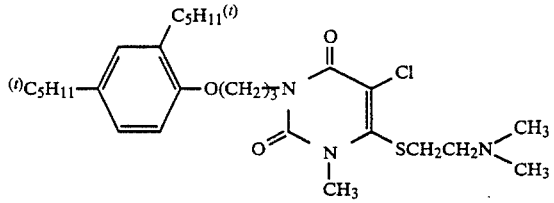
(26)
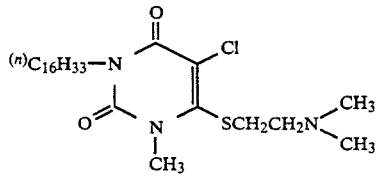
(27)
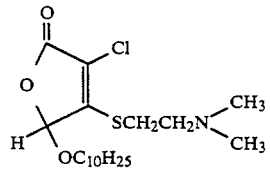
(28)
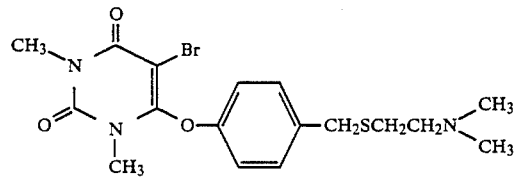
(29)
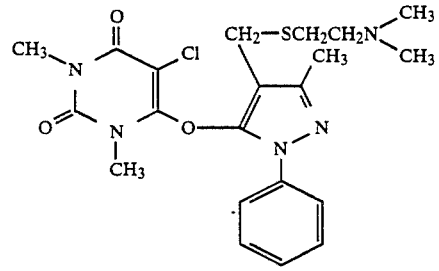

-continued (30)

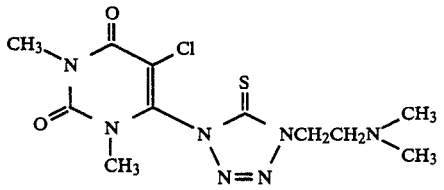

(31)

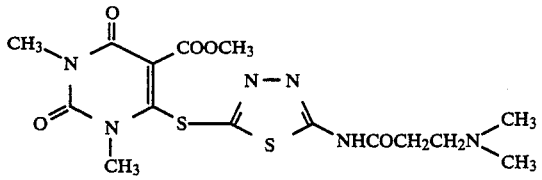

(32)

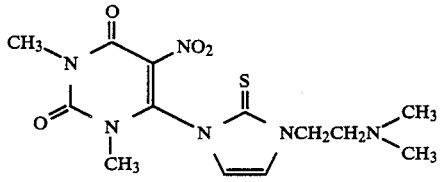

(33)

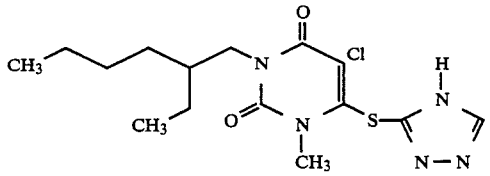

In the above compound,

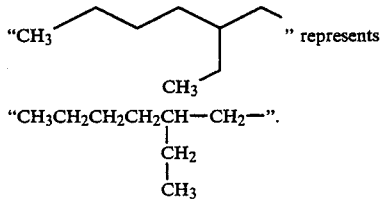

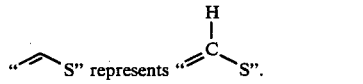

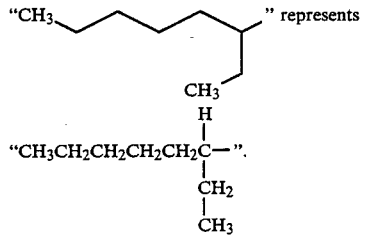

In addition to the specific compounds illustrated above, the compounds described in JP-A-No. 59-201057, JP-A-No. 61-43739 and JP-A-No. 61-95347 can be employed as the compounds represented by formula (IV). The above references describes as to a bleach-fixing treatment, but examples in the references disclose only examples in which a bleaching treatment or a fixing treatment is separately carried out.

The compounds represented by formula (IV) according to the present invention can be synthesized with reference to the methods as described in the above-mentioned patent applications. Further they can be easily synthesized according to the following specific examples of synthesis methods or in a similar manner thereto.

SYNTHESIS EXAMPLE 1

Synthesis of Compound (1)

6-Chloro-1,3-dimethyluracil was synthesized according to the method as described in *Liebigs Ann. Chem.*, Bd. 612, page 161 (1958) in the following manner.

276 g (3.14 mol) of 1,3-dimethylurea and 376 g (3.62 mol) of malonic acid were dissolved in 600 ml of glacial acetic acid at 60° to 70° C. To the solution was added 1250 ml of acetic anhydride and the temperature was gradually raised to 90° C. After stirring for 6 hours, the reaction mixture was allowed to stand at room temperature overnight and then the glacial acetic acid and acetic anhydride were distilled off under reduced pressure. The residue was poured into 500 ml of ethanol while it was still hot, the crystals thus deposited were collected by filtration and refluxed by heating in a mixture of 380 ml of concentrated hydrochloric acid and 400 ml of water for 2 hours. The mixture was allowed to stand under cooling with ice for 6 hours, the crystals thus-deposited were collected by filtration and washed with a small amount of ethanol to obtain 360 g of 1,3-dimethylbarbituric acid.

To 110 g of 1,3-dimethylbarbituric acid thus obtained was added 32 ml of water and then was gradually added dropwise 800 ml of phosphorus oxychloride. The mixture was refluxed by heating for 1.5 hours, the phosphorus oxychloride was distilled off under normal pressure and the residue was poured onto ice while it was still hot. The crystals thus deposited were collected by filtration, the filtrate was extracted three times with chloroform and dried with anhydrous sodium sulfate. The chloroform was distilled off and the residue thus obtained was recrystallized from water together with the crystals obtained above to obtain 80 g of 6-chloro-1,3-dimethyluracil.

To 70 ml of an acetonitrile solution containing 21 g of 6-chloro-1,3-dimethyluracil thus obtained was added 16 g of N-chlorosuccinimide under cooling with ice (at the solution temperature of 5° C.). The temperature was gradually raised to 35° C. After further stirring for 1 hour, 70 ml of water was added to the reaction solution, and the crystals thus deposited were collected by filtration, washed with a cold solvent mixture of 18 ml of acetonitrile and 18 ml of water and dried to obtain 18 g of 5,6-dichloro-1,3-dimethyluracil.

To 15 ml of a methanol solution containing 8 g of 2-dimethylaminoethanethiol hydrochloride was added dropwise 24 g of sodium methoxide as a 28 wt % methanol solution in a nitrogen atmosphere and the mixture was stirred at room temperature for 10 minutes. Then, the mixture was filtered and the filtrate was concentrated to a solid under reduced pressure. The resulting residue was dissolved in 15 ml of acetonitrile and the solution was added dropwise at room temperature to 20 ml of acetonitrile solution containing 11.8 g of 5,6-dichloro-1,3-dimethyluracil using a dropping funnel. The reaction mixture was stirred for 2 hours and then filtered. The filtrate was concentrated under reduced pressure and to the resulting residue were added 20 ml of ethanol and 12 ml of a 20 wt % ethanol solution of hydrochloric acid. Then, the ethanol was removed under reduced pressure, to the residue was added 100 ml of ethyl acetate and the crystals thus-deposited were collected by filtration to obtain 13.2 g of hydrochloride of Compound (1). Melting Point: 163° to 166° C.

SYNTHESIS EXAMPLE 2

Synthesis of Compound (7)

Into a 300 ml reaction vessel equipped with a distillation apparatus, 50 g of 2-ethylhexylamine, 29 g of methyl carbamate and 100 ml of toluene were placed, and to the mixture was added 0.1 g of dibutyl tin oxide as a catalyst and heated with stirring. Methanol formed during the reaction was removed, when the reflux temperature was raised to 110° C., i.e.,the boiling point of toluene, the distillation apparatus was taken off and instead a reflux condenser was attached and the mixture was refluxed by heating for 30 minutes with stirring, then allowed to cool. The toluene was distilled off under reduced pressure, and the residue was washed with n-hexane and collected by filtration to obtain 61 g of N-(2-ethylhexyl)urea.

A solution of 50 g of N-(2-ethylhexyl)urea thus obtained and 36 g of malonic acid in 100 ml of acetic acid was heated at 80° C. and stirred for 4 hours. After allowing the mixture to cool, the acetic acid was removed under reduced pressure and extracted by adding 100 ml of water and 500 ml of chloroform. The organic phase was washed with a saturated aqueous solution of sodium hydrogen carbonate and then a saturated aqueous sodium chloride solution, and dried with anhydrous magnesium sulfate. The chloroform was distilled off under reduced pressure, the residue was washed with n-hexane and collected by filtration to obtain 64 g of N-(2-ethylhexyl)barbituric acid.

To 40 g of N-(2-ethylhexyl)barbituric acid thus obtained was added 120 ml of phosphorus oxychloride, and then 3 ml of water was gradually added dropwise to the mixture. After refluxing by heating for 2 hours, the phosphorus oxychloride was distilled off under normal atmospheric pressure, and the residue was poured into ice water while it was still hot. The mixture was extracted three times with 200 ml of chloroform, and the organic phase were collected and dried with anhydrous magnesium sulfate. The chloroform was distilled off under reduced pressure, to the residue was added n-hexane, and the crystals thus-deposited were collected by filtration and recrystallized from ethyl acetate to obtain 32 g of 6-chloro-3-(2-ethylhexyl)uracil as yellow crystals.

To a solution containing 20 g of 6-chloro-3-(2-ethylhexyl)uracil thus obtained in 50 ml of dimethylformamide was added 11 g of potassium carbonate and then 12.1 g of methyl iodide was added thereto, and the mixture was stirred at room temperature for 1 hour. The reaction solution was filtered, the filtrate was poured into water and extracted twice with 100 ml of chloroform. The organic phase was washed with a saturated aqueous sodium chloride solution and dried with anhydrous magnesium sulfate. The chloroform was distilled off under reduced pressure to obtain 21 g of 6-chloro-3-(2-ethylhexyl)-1-methyluracil as an oily product.

To a solution containing 20 g of 6-chloro-3-(2-ethylhexyl)-1-methyluracil thus obtained in 50 ml of acetonitrile was added 8.6 g of N-chlorosuccinimide, and the mixture was heated to 40° C. and stirred for 2 hours. After allowing the mixture to cool, the acetonitrile was distilled off under reduced pressure, to the residue was added water and it was extracted with 100 ml of chloroform. The organic phase was washed with a saturated aqueous sodium chloride solution and dried with anhydrous magnesium sulfate. The chloroform was distilled off under reduced pressure, and the residue was purified by silica gel chromatography to obtain 22 g of 5,6-dichloro-3-(2-ethylhexyl)-1-methyluracil as an oily product.

To 20 ml of a methanol solution containing 10 g of 1-(2-dimethylaminoethyl)-5-mercaptotetrazole hydrochloride was added dropwise 20 g of sodium methoxide as a 28 wt % methanol solution in a nitrogen atmosphere and the mixture was stirred at room temperature for 10 minutes. Then, the mixture was filtered and the filtrate was concentrated to a solid under reduced pressure. The resulting residue was dissolved in 20 ml of acetonitrile and the solution was added dropwise at room temperature to 20 ml of an acetonitrile solution containing 14.6 g of 5,6-dichloro-3-(2-ethylhexyl)-1-methyluracil using a dropping funnel. The reaction mixture was stirred for 1.5 hours and then filtered. The filtrate was concentrated under reduced pressure and to the resulting residue were added 20 ml of ethanol and 15 ml of a 20 wt % ethanol solution of hydrochloric acid. Then, the ethanol was removed under reduced pressure, to the residue was added 100 ml of ethyl acetate and the crystals thus-deposited were collected by filtration to obtain 17.6 g of hydrochloride of Compound (7). Melting Point: 124° to 126° C.

SYNTHESIS EXAMPLE 3

Synthesis of Compound (10)

2-Benzoyl-3-chlorocyclohexenone-2 was synthesized according to the method described in *Chem. Pharm. Bull.*, 29 (5), pages 1312 to 1320 (1981) in the following manner.

To 300 ml of a chloroform solution containing 14.6 g of cyclohexane-1,3-dione was added 10 g of pyridine and then 18 g of benzoyl chloride was added dropwise thereto. After stirring at room temperature for 4 hours, the reaction mixture was poured into ice water. The organic phase was washed with dilute hydrochloric acid, a saturated aqueous sodium hydrogen carbonate solution, and then an aqueous sodium chloride solution, and dried with anhydrous magnesium sulfate, and thereafter it was concentrated to a solid to obtain 3-benzoyloxycyclohexene-2 as a crude product.

The 3-benzoyloxycyclohexene-2 thus obtained was added without further purification to 320 ml of a dichloroethane solution containing 30 g of anhydrous aluminium chloride. After stirring at room temperature for 17 hours, the reaction mixture was poured into a cold 10 wt % aqueous hydrochloric acid solution. The organic phase was separated and the aqueous phase was extracted twice with dichloroethane. The organic phases were gathered, washed with an aqueous sodium chloride solution and dried with anhydrous magnesium sulfate. The dichloroethane was distilled off under reduced pressure. To the residue were added the minimum amount of diethyl ether and a 1N aqueous solution of sodium hydroxide necessary to dissolve it. The aqueous phase was acidified with concentrated hydrochloric acid and extracted with diethyl ether. The organic phase was dried with anhydrous magnesium sulfate and then the diethyl ether was distilled off under reduced pressure. To the residue was added n-hexane and recrystallized therefrom to obtain 13 g of 2-benzoylcyclohexane-1,3-dione.

To 5 g of 2-benzoylcyclohexane-1,3-dione thus obtained was added 4 ml of oxalyl chloride under cooling with ice, and the mixture was stirred for 3 hours. The excess amount of oxalyl chloride was distilled off under reduced pressure, and the reaction mixture was distilled under reduced pressure to obtain 4.2 g of 2-benzoyl-3-chlorocyclohexenone-2. Boiling Point: 185° to 196° C. at 10.1 mmHg.

To 15 ml of an acetonitrile solution containing 5 g of 5-mercapto-1-[2-(1-imidazolyl)ethyl]tetrazole was added dropwise 10 ml of an acetonitrile solution containing 46 g of 1,8-diazabicyclo[5,4,0]undecene-7 (DBU) in a nitrogen atmosphere and the mixture was stirred at room temperature for 5 minutes. Then, 10 ml of an acetonitirile solution containing 2.6 g of 2-benzoyl-3-chlorocyclohexenone-2 was added thereto and the mixture was stirred at room temperature for 2 hours. The acetonitrile was distilled off under reduced pressure, to the residue were added 3 ml of hydrochloric acid and 30 ml of water and then it was extracted with 100 ml of chloroform. The organic phase was washed with a saturated aqueous sodium chloride solution, dried with anhydrous magnesium sulfate and then the chloroform was distilled off under reduced pressure. To the residue was added ethyl acetate, the crystals thus-deposited were collected by filtration to obtain 7.3 g of Compound (10). Melting Point: 168° to 171° C.

SYNTHESIS EXAMPLE 4

Synthesis of Compound (12)

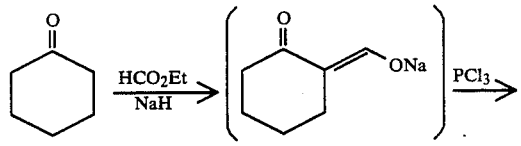

(A) (B)

-continued

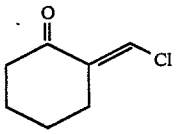

(C)

20 g (0.2 mol) of cyclohexanone and 16 g (0.2 mol) of ethyl formate were dissolved in 400 ml of dry ether, and cooled in an ice bath. To the cooled solution was added 16 g (0.4 mol) of NaH (concentration: 60 wt %) over a 1 hour period. After the addition was concluded, the stirring was continued at room temperature for 6 hours. The reaction mixture (B in the foregoing reaction scheme precipitated) was kept cooling in an ice bath and thereto 150 ml of an ether solution containing 27 g (0.2 mol) of $PCl_3$ was added dropwise. After the conclusion of dropwise addition, the stirring was continued at room temperature for 3 hours. The crystals thus deposited were removed by filtration under reduced pressure. The mother liquor was concentrated to yield 31 g of an oily product C.

To 60 ml of a methanol solution containing 29 g of 2-ethylaminoethanethiol hydrochloride was added dropwise 85 g of sodium methoxide as a 28 wt % methanol solution in a nitrogen atmosphere and the mixture was stirred at room temperature for 10 minutes. Then, the mixture was filtered and the filtrate was concentrated to a solid under reduced pressure. The resulting residue was dissolved in 100 ml of acetonitrile and the solution was added dropwise to 60 ml of an acetonitrile solution containing 31 g of C obtained above using a dropping funnel under cooling with ice. The reaction mixture was stirred for 3 hours and then filtered. The filtrate was concentrated under reduced pressure and to the resulting residue were added 50 ml of ethanol and 50 ml of a 20 wt % ethanol solution of hydrochloric acid. Then the ethanol was removed under reduced pressure, to the residue was added tetrahydrofuran (THF) and the crystals thus-deposited were collected by filtration to obtain 49 g of the hydrochloride of Compound (12).

SYNTHESIS EXAMPLE 5

Synthesis of Compound (14)

3,4,6-Trichlorocoumarin was synthesized according to the method as described in *J. Am. Chem. Soc.*, Vol. 81, page 2266 (1959) in the following manner.

To 39 g of anhydrous aluminium chloride was added 120 ml of carbon disulfide and the resulting slurry was gradually added to 50 ml of a carbon disulfide solution containing 19 g of p-chlorophenol. The mixture was stirred until the generation of hydrogen chloride gas was completed at room temperature. Then, 56.2 g of hexachloropropene was added dropwise thereto over a period of 20 minutes and the mixture was stirred until the generation of hydrogen chloride gas was completed at room temperature. After distilling off the carbon disulfide under normal pressure, to the residue was added a cold aqueous sulfuric acid solution (20 ml of concentrated sulfuric acid and 100 ml of water) and the mixture was stirred for 10 minutes. The crystals thus-deposited were collected by filtration and recrystallized from diethyl ether to obtain 18.2 g of 3,4,6-trichlorocoumarin. Melting Point: 133° to 135° C.

To 10 ml of methanol solution containing 3 g of 5-mercapto-1-(2-dimethylaminoethyl)tetrazole was added 3.6 g of sodium methoxide as a 28 wt % methanol solution in a nitrogen atmosphere, and the mixture was stirred at room temperature for 5 minutes and concentrated under reduced pressure. To the resulting residue was added 10 ml of acetonitrile and then was added dropwise 10 ml of an acetonitrile solution containing 4.3 g of 3,4,6-trichlorocoumarin. The mixture was stirred at room temperature for 2 hours and then filtered. The filtrate was concentrated to a solid under reduced pressure and to the resulting residue were added 5 ml of ethanol and then 4 ml of a 20 wt % ethanol solution of hydrochloric acid. Then the ethanol was removed under reduced pressure, to the residue was added 50 ml of ethyl acetate and the crystals thus-deposited were collected by filtration to obtain 5.1 g of hydrochloride of Compound (14). Melting Point: 171° to 173° C.

The compound represented by formula (I) used in the present invention can be added to any or both layers including a light-sensitive emulsion layer and a light-insensitive layer, such as an anti halation layer, a red sensitive emulsion layer, a green sensitive emulsion layer, a blue sensitive emulsion layer, a yellow filter layer and an interlayer. It is preferred to incorporate it into a light-insensitive layer.

The amount of the compound according to the present invention to be added is generally from 0.01 mol % to 100 mol %, preferably from 0.1 mol % to 50 mol %, and particularly preferably from 1 mol % to 20 mol % based on the total coating amount of silver.

The compound according to the present invention is dissolved or dispersed using an alcohol such as methanol, water, tetrahydrofuran, acetone, gelatin, a surface active agent, and then added to a coating solution. Also, it can be dissolved in an organic solvent having a high boiling point, and emulsified and dispersed using a homogenizer in a manner similar to the incorporation of a coupler.

In the photographic emulsion layers of the photographic light-sensitive material used in the present invention, any of silver bromide, silver iodobromide, silver chlorobromide, silver chloroiodobromide, silver chloride and silver chloroiodide may be used as silver halide. A preferably employed silver halide is silver iodobromide, silver iodochloride or silver iodochlorobromide each containing up to about 30 mol % of silver iodide. Silver iodobromide containing from about 2 mol % to about 25 mol % of silver iodide is particularly preferred.

Silver halide grains in the silver halide photographic emulsion may have a regular crystal structure, for example, a cubic, octahedral or tetradecahedral structure, an irregular crystal structure, for example, a spherical or tabular structure, a crystal defect, for example, a twin plane, or a composite structure thereof.

The grain size of silver halide may be varied and include from fine grains of about 0.2 micron or less to large size grains of about 10 microns each as the diameter of the projected area. Further, a polydisperse emulsion and a monodisperse emulsion may be used. The silver halide photographic emulsion used in the present invention can be prepared using known methods, for example, those as described in *Research Disclosure,* No. 17643 (December, 1978), pages 22 to 23, "I. Emulsion Preparation and Types" and ibid., No. 18716 (November, 1979), page 648.

Monodisperse emulsions as described in U.S. Pat. Nos. 3,574,628, and 3,655,394, and British Patent No. 1,413,748, are preferably used in the present invention. Further, tabular silver halide grains having an aspect ratio of about 5 or more can be employed in the present invention. The tabular grains may be easily prepared by the method as described in Gutoff, *Photographic Science and Engineering,* Vol. 14, pages 248 to 257 (1970), U.S. Pat. Nos. 4,434,226, 4,414,310, 4,433,048 and 4,439,520, and British Patent No. 2,112,157.

The crystal structure of silver halide grains may be uniform, composed of different halide compositions between the inner portion and the outer portion, or may be a stratified structure.

Further, silver halide emulsions in which silver halide grains having different compositions are connected by epitaxial junctions or silver halide emulsions in which silver halide grains are connected with compounds other than silver halide such as silver thiocyanate or lead oxide may also be employed.

Moreover, a mixture of grains having a different crystal structure may be used.

The silver halide emulsions used in the present invention are usually treated by physical ripening, chemical ripening and spectral sensitization. Various additives which can be employed in these steps are described in *Research Disclosure,* No. 17643 (December, and ibid., No. 18716 (November, 1979) as summarized in the table shown below.

Further, known photographic additives which can be used in the present invention are also described in the above mentioned publications and related items are summarized in the table below.

| Kind of Additives | RD 17643 | RD 18716 |
|---|---|---|
| 1. Chemical Sensitizers | Page 23 | Page 648, right column |
| 2. Sensitivity Increasing Agents | — | Page 648, right column |
| 3. Spectral Sensitizers and Supersensitizers | Pages 23 to 24 | Page 648, right column to page 649, right column |
| 4. Whitening Agents | Page 24 | — |
| 5. Antifoggants and Stabilizers | Pages 24 to 25 | Page 649, right column |
| 6. Light-Absobers, Filter Dyes and Ultraviolet Ray Absorbers | Pages 25 to 26 | Page 649, right column to page 650, left column |
| 7. Antistaining Agents | Page 25, right column | Page 650, left column to right column |
| 8. Dye Image Stabilizers | Page 25 | — |
| 9. Hardeners | Page 26 | Page 651, left column |
| 10. Binders | Page 26 | Page 651, left column |
| 11. Plasticizers and Lubricants | Page 27 | Page 650, right column |
| 12. Coating Aids and Surfactants | Pages 26 to 27 | Page 650, right column |
| 13. Antistatic Agents | Page 27 | Page 650, right column |

In the present invention, various color couplers can be employed and specific examples thereof are described in the patents cited in *Research Disclosure,* No. 17643, "VII-C" to "VII-G".

As yellow couplers used in the present invention, for example, those described in U.S. Pat. Nos. 3,933,501, 4,022,620, 4,326,024 and 4,401,752, JP-B-No. 58-10739, British Patent Nos. 1,425,020 and 1,476,760 are preferred.

As magenta couplers used in the present invention, 5-pyrazolone type and pyrazoloazole type compounds are preferred. Magenta couplers as described in U.S. Pat. Nos. 4,310,619 and 4,351,897, European Patent No. 73,636, U.S. Pat. Nos. 3,061,432 and 3,725,067, *Research Disclosure,* No. 24220 (June, 1984), JP-A-Nos. 60-33552, *Research Disclosure,* No. 24230 (June, 1984), JP-A-Nos. 60-43659, U.S. Pat. Nos. 4,500,630 and 4,540,654 are particularly preferred.

As cyan couplers used in the present invention, phenol type and naphthol type couplers are exemplified. Cyan couplers as described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) No. 3,329,729, European Patent No. 121,365A, U.S. Pat. Nos. 3,446,622, 4,333,999, 4,451,559 and 4,427,767 and European Patent No. 161,626A are preferred.

As colored couplers for correcting undesirable absorptions of dyes formed, those described in *Research Disclosure,* No. 17643, "VII-G", U.S. Pat. No. 4,163,670, JP-B-No. 57-39413, U.S. Pat. Nos. 4,004,929 and 4,138,258 and British Patent No. 1,146,368 are preferably employed.

As couplers capable of forming appropriately diffusible dyes, those described, in U.S. Pat. No. 4,366,237, British Patent No. 2,125,570, European Patent No. 96,570, and West German Patent Application (OLS) No. 3,234,533 are preferably employed.

Typical examples of polymerized dye forming couplers are described in U.S. Pat. Nos. 3,451,820, 4,080,211 and 4,367,282 and British Patent No. 2,102,173.

Couplers capable of releasing a photographically useful residue during the course of coupling can be also employed preferably in the present invention. As DIR couplers capable of releasing a development inhibitor, those described in the patents cited in *Research Disclosure,* No. 17643, "VII-F" described above, JP-A-No. 57-151944, JP-A-No. 57-154234 and JP-A-No. 60-184248 and U.S. Pat. No. 4,248,962 are preferred.

As couplers which release imagewise a nucleating agent or a development accelerator at the time of development, those described in British Patent Nos. 2,097,140 and 2,131,188, JP-A-No. 59-157638 and JP-A-No. 59-170840 are preferred.

Furthermore, competing couplers such as those described in U.S. Pat. No. 4,130,427, poly-equivalent couplers such as those described in U.S. Pat. Nos. 4,283,472, 4,338,393 and 4,310,618, DIR redox compound releasing couplers such as those described in JP-A-No. 60-185950, couplers capable of releasing a dye which turns to a colored form after being released such as those described in European Patent No. 173,302A, and the like may be employed in the photographic light-sensitive material of the present invention.

The couplers which can be used in the present invention can be introduced into the photographic light-sensitive material according to various known dispersing methods.

Suitable examples of organic solvent having a high boiling point which can be employed in an oil droplet-in-water type dispersing method are described in U.S. Pat. No. 2,322,027.

The processes and effects of latex dispersing methods and specific examples of latexes for loading are described in U.S. Pat. No. 4,199,363, West German Patent Application (OLS) Nos. 2,541,274 and 2,541,230.

Suitable supports which can be used in the present invention are described, for example, in *Research Disclosure,* No. 17643, page 28 and ibid., No. 18716, page 647, right column to page 648, left column, as mentioned above.

The color photographic light-sensitive material according to the present invention can be subjected to development processing in a conventional manner as described in *Research Disclosure,* No. 17643, pages 28 to 29 and ibid., No. 18716, page 651, left column to right column, as mentioned above.

The present invention can be applied to various kinds of color photographic light-sensitive materials, for example, color negative films for photographing (for general use, for cinematography, etc.), color reversal films (for slides, for cinematography, etc., also including cases in which couplers are not incorporated into the photographic light-sensitive materials), color printing paper, color positive films (for cinematography, etc.), color reversal paper, direct positive color photographic light-sensitive materials, etc. Particularly, it is preferably employed for color negative films for photographing and color reversal films.

A color developing solution which can be used in development processing of the color photographic light-sensitive material according to the present invention is an alkaline aqueous solution containing preferably an aromatic primary amine type color developing agent as a main component. As the color developing agent, while an aminophenol compound is useful, a p-phenylenediamine compound is preferably employed. Typical examples of the p-phenylenediamine type compounds include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, or sulfates, hydrochlorides or p-toluenesulfonates thereof.

Two or more kinds of color developing agents may be employed in combination, depending on the purpose.

The color developing solution can ordinarily contain pH buffering agents, such as carbonates, borates or phosphates, of alkali metals; and development inhibitors or anti-fogging agents such as bromides, iodides, benzimidazoles, benzothiazoles, or mercapto compounds. Further, if desired, the color developing solution may contain various preservatives such as hydroxylamine, diethylhydroxylamine, sulfites, hydrazines, phenylsemicarbazides, triethanolamine, catechol sulfonic acids, triethylenediamine(1,4-diazabicyclo[2,2,2]octane); organic solvents such as ethylene glycol, diethylene glycol; development accelerators such as benzyl alcohol, polyethylene glycol, quarternary ammonium salts, amines; dye forming couplers; competing couplers; fogging agents such as sodium borohydride; auxiliary developing agents such as 1-phenyl-3-pyrazolidone; tackifier; and various chelating agents represented by aminopolycarboxylic acids, aminopolyphosphonic acids, alkylphosphonic acids, and phosphonocarboxylic acids. Representative examples of the chelating agents include ethylenediaminetetraacetic acid, nitrilotriacetic acid, diethylenetriaminepentaacetic acid, cyclohexanediaminetetraacetic acid, hydroxyethyl iminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid), and salts thereof.

In development processing for reversal color light-sensitive materials, color development is usually conducted after black-and-white development. In a black-and-white developing solution, known black-and-white developing agents, for example, dihydroxybenzenes such as hydroquinone, 3-pyrazolidones such as 1-phenyl-3-pyrazoldione, or aminophenols such as N-methyl-p-aminophenol, may be employed individually or in a combination.

The pH of the color developing solution or the black-and-white developing solution is usually in a range from 9 to 12. Further, the amount of replenishment for the developing solution can be varied depending on color photographic light-sensitive materials to be processed, but is generally not more than 3 liters per square meter of the photographic light-sensitive material. The amount of replenishment can be reduced to not more than 500 ml by decreasing the bromide ion concentration in the replenisher. In the case of reducing the amount of replenishment, it is preferred to prevent evaporation and aerial oxidation of the processing solution by means of reducing the area of a processing tank which is contact with the air. Further, the amount of replenishment can be reduced by restraining accumulation of bromide ion in the developing solution.

After color development, the photographic emulsion layers are usually subjected to a bleach-fixing processing, in the present invention. The bleach processing can be performed simultaneously with fix processing (bleach-fix processing), or it can be performed independently from the fix processing. Further, for the purpose of rapid processing, a processing method wherein after bleach processing bleach-fix processing is conducted may be employed. Moreover, it may be appropriate depending on the purpose to process using a continuous two tank bleach-fixing bath, to carry out fix processing before bleach-fix processing, or to conduct bleach processing after bleach-fix processing.

Examples of bleaching agents which can be employed in the bleach processing or bleach-fix processing include compounds of a multivalent metal such as iron(III), cobalt(III), chromium(VI), copper(II); peracids; quinones; and nitro compounds. Representative examples of the bleaching agents include ferricyanides; dichloromates; organic complex salts of iron(III) or cobalt(III), for example, complex salts of aminopolycarboxylic acids (such as ethylenediaminetetraacetic acid, diethylenetriaminepentaacetic acid, cyclohexanediaminetetraacetic acid, methyliminodiacetic acid, 1,3-diaminopropanetetraacetic acid, glycol ether diaminetetraacetic acid), or complex salts of organic acids (such as citric acid, tartaric acid, malic acid); persulfates; bromates; permanganates; and nitrobenzenes. Of these compounds, iron(III) complex salts of aminopolycarboxylic acids, particularly iron(III) complex salt of ethylenediaminetetraacetic acid and persulfates are preferred in view of rapid processing and reduced environmental pollution. Furthermore, iron(III) complex salts of aminopolycarboxylic acids are particularly useful in both bleaching solutions and bleach-fixing solutions.

The pH of the bleaching solution or bleach-fixing solution containing an iron(III) complex salt of an aminopolycarboxylic acid is usually in a range from 5.5 to 8. For the purpose of rapid processing, it is possible to process at pH lower than the above described range.

In the bleaching solution, the bleach-fixing solution or a prebath thereof, a bleach accelerating agent can be used, if desired. Specific examples of suitable bleach accelerating agents include compounds having a mercapto group or a disulfide bond as described in U.S. Pat. No. 3,893,858, West German Patent No. 1,290,812, JP-A-No. 53-95630, *Research Disclosure,* No. 17129 (July 1978); thiazolidine derivatives as described in JP-A-No. 50-140129; thiourea derivatives as described in U.S. Pat. No. 3,706,561; iodides as described in JP-A-No. 58-16235; polyoxyethylene compounds as described in West German Patent No. 2,748,430; polyamine compounds as described in JP-B-No. 45-8836; and bromide ions. Of these compounds, compounds having a mercapto group or a disulfide group are preferred in view of their large bleach accelerating effects. Particularly, the compounds as described in U.S. Pat. No. 3,893,858, West German Patent No. 1,290,812 and JP-A-No. 53-95630 are preferred. Further, the compounds as described in U.S. Pat. No. 4,552,834 are also preferred. These bleach accelerating agents may be incorporated into the color photographic light-sensitive material. These bleach accelerating agents are particularly effectively employed when color photographic light-sensitive materials for photographing are subjected to bleach-fix processing.

As fixing agents which can be employed in the fixing solution or bleach-fixing solution, thiosulfates, thiocyanate, thioether compounds, thioureas, a large amount of iodide. are typical. Of these compounds, thiosulfates are generally employed. Particularly, ammonium thiosulfate is most widely employed. It is preferred to use sulfites, bisulfites or carbonylbisulfite adducts as preservatives in the bleach-fixing solution.

The desilvering time of the present invention is generally from 30 seconds to 15 minutes, preferably from 0 seconds to 5 minutes, and more preferably from 30 seconds to 3 minutes.

After a desilvering step, the silver halide color photographic material according to the present invention is generally subjected to a water washing step and/or a stabilizing step.

The amount of water required for the water washing step may be vaned in a wide range depending on the characteristics of photographic light-sensitive materials (due to elements used therein, for example, couplers, etc.), uses thereof, the temperature of washing water, the number of, water washing tanks (stages), the replenishment system such as countercurrent or co-current, or other various conditions. The relationship between the number of water washing tanks and the amount of water in a multistage countercurrent system can be determined based on the method described in *Journal of the Society of Motion Picture and Television Engineers,* Vol. 64, pages 248 to 253 (May, 1955).

According to the multi-stage countercurrent system described in the above publication, the amount of water for washing can be significantly reduced. However, the increase in standing time of water in a tank causes propagation of bacteria and some problems, such as adhesion of scum formed on the photographic materials, etc. occur. In the method for processing the silver halide color photographic material according to the present invention, a method for reducing amounts of calcium ions and magnesium ions as described in JP-A-No. 61-131632 can be particularly effectively employed in order to solve such problems. Further, sterilizers, for example, isothiazolone compounds as described in JP-A-No. 57-8542, cyabendazoles, chlorine type sterilizers such as sodium chloroisocyanurate, benzotriazoles, sterilizers as described in Hiroshi Horiguchi, Bokin-Bobai No Kagaku, Biseibutsu No Mekkin-, Sakkin-, Bobai-Gijutsu, edited by Eiseigijutsu Kai, Bokin-Bobaizai Jiten, edited by Nippon Bokin-Bobai Gakkai, etc. can be employed.

The pH of the washing water used in the processing of the photographic light-sensitive materials according to the present invention is usually from 4 to 9, preferably from 5 to 8. The temperature of washing water and time for the water washing step can be variously set depending on the characteristics or uses of photographic light-sensitive materials. However, it is typical to select a range of from 15° C. to 45° C. and a period from 20 sec. to 10 min. and preferably a range of from 25° C. to 40° C. and a period from 30 sec. to 5 min.

The processing method of the present invention can also employ a stabilizing solution in place of the above-described water washing step. In such a stabilizing process, any of known methods as described in JP-A-No. 57-8543, JP-A-No. 58-14834 and JP-A-No. 60-220345 can be employed.

Further, it is possible to conduct the stabilizing process subsequent to the above-described water washing process. One example thereof is a stabilizing bath containing formalin and a surface active agent, which is employed as a final bath in the processing of color photographic light-sensitive materials for photographing. To such a stabilizing bath, various chelating agents and antimolds may also be added.

Overflow solutions from replenishment for the above-described washing water and/or stabilizing solution may be reused in other steps such as a desilvering step.

For the purpose of simplification and acceleration of processing, a color developing agent may be incorporated into the silver halide color photographic material processed according to the present invention. In order to incorporate the color developing agent, it is preferred to employ various precursors of color developing agents. Suitable examples of the precursors of developing agents include indoaniline type compounds as described in U.S. Pat. Nos. 3,342,597, Schiff's base type compounds as described in U.S. Pat. No. 3,342,599 and *Research Disclosure,* No. 14850 and ibid., No. 15159, aldol compounds as described in *Research Disclosure,* No. 13924, metal salt complexes as described in U.S. Pat. No. 3,719,492, urethane type compounds as described in JP-A-No. 53-135628.

Further, the silver halide color photographic material according to the present invention may contain, if desired, various 1-phenyl-3-pyrazolidones for the purpose of accelerating color development. Typical examples of the compounds include those as described in JP-A-No. 56-64339, JP-A-No. 57-144547, and JP-A-No. 58-115438.

In the present invention, various kinds of processing solutions can be employed in a temperature range from 10° C. to 50° C. Although a standard temperature is from 33° C. to 38° C., it is possible to carry out the processing at higher temperatures in order to accelerate the processing whereby the processing time is shortened, or at lower temperatures in order to achieve improvement in image quality and to maintain stability of the processing solutions.

Further, for the purpose of reducing the amount of silver employed in the color photographic light-sensitive material, the photographic processing may be conducted utilizing color intensification using cobalt or hydrogen peroxide as described in West German Patent Application (OLS) No. 2,226,770 or U.S. Pat. No. 3,674,499.

The present invention is explained in greater detail with reference to the following examples, but the present invention is not to be construed as being limited thereto Unless otherwise indicated, all parts, percents and ratios are by weight.

EXAMPLE 1

Preparation of Sample 101

On a cellulose triacetate film support provided with a subbing layer were coated layers having the compositions shown below to prepare a multilayer color photographic light-sensitive material which was designated Sample 101.

Regarding the compositions of the layers, coated amounts of silver halide and colloidal silver are shown by a silver coated amount in units of g/m$^2$, those of couplers, additives and gelatin are shown in units of g/m$^2$, and those of sensitizing dyes are shown as molar amounts per mol of silver halide present in the same layer.

| | |
|---|---|
| **First Layer: Antihalation Layer** | |
| Black colloidal silver | 0.2 |
| Gelatin | 1.3 |
| ExM-8 | 0.06 |
| UV-1 | 0.1 |
| UV-2 | 0.2 |
| Solv-1 | 0.01 |
| Solv-2 | 0.01 |
| **Second Layer: Interlayer** | |
| Fine grain silver bromide (average particle size: 0.07 μm) | 0.10 |
| Gelatin | 1.5 |
| UV-1 | 0.06 |
| UV-2 | 0.03 |
| ExC-2 | 0.02 |
| ExF-1 | 0.004 |
| Solv-1 | 0.1 |
| Solv-2 | 0.09 |
| **Third Layer: First Red-Sensitive Emulsion Layer** | |
| Silver iodobromide emulsion (silver iodide: 2 mol %; internal high silver iodide type; diameter of equivalent sphere: 0.3 μm; coefficient of variation of diameter of equivalent sphere: 29%; mixture of regular crystals and twin crystals; diameter/thickness ratio: 2.5) | 0.4 (as silver) |
| Gelatin | 0.6 |
| ExS-1 | $1 \times 10^{-4}$ |
| ExS-2 | $3 \times 10^{-4}$ |
| ExS-3 | $1 \times 10^{-5}$ |
| ExC-3 | 0.06 |
| ExC-4 | 0.06 |
| ExC-7 | 0.04 |
| ExC-2 | 0.03 |
| Solv-1 | 0.03 |
| Solv-3 | 0.012 |
| **Fourth Layer: Second Red-Sensitive Emulsion Layer** | |
| Silver iodobromide emulsion (silver iodide: 5 mol %; internal high silver iodide type; diameter of equivalent sphere: 0.7 μm; coefficient of variation of diameter of equivalent sphere: 25%; mixture of regular crystals and twin crystals; diameter/thickness ratio: 4) | 0.7 (as silver) |
| Gelatin | 0.5 |
| ExS-1 | $1 \times 10^{-4}$ |
| ExS-2 | $3 \times 10^{-4}$ |
| ExS-3 | $1 \times 10^{-5}$ |
| ExC-3 | 0.24 |
| ExC-4 | 0.24 |

-continued

| | |
|---|---|
| ExC-7 | 0.04 |
| ExC-2 | 0.04 |
| Solv-1 | 0.15 |
| Solv-3 | 0.02 |
| **Fifth Layer: Third Red-Sensitive Emulsion Layer** | |
| Silver iodobromide emulsion (silver iodide: 10 mol %; internal high silver iodide type; diameter of equivalent sphere: 0.8 μm; coefficient of variation of diameter of equivalent sphere: 16%; mixture of regular crystals and twin crystals; diameter/thickness ratio: 1.3) | 1.0 (as silver) |
| Gelatin | 1.0 |
| ExS-1 | $1 \times 10^{-4}$ |
| ExS-2 | $3 \times 10^{-4}$ |
| ExS-3 | $1 \times 10^{-5}$ |
| ExC-5 | 0.01 |
| ExC-6 | 0.13 |
| Solv-1 | 0.01 |
| Solv-2 | 0.05 |
| **Six Layer: Interlayer** | |
| Gelatin | 1.0 |
| Cpd-1 | 0.03 |
| Solv-1 | 0.05 |
| **Seventh Layer: First Green-Sensitive Emulsion Layer** | |
| Silver iodobromide emulsion (silver iodide: 2 mol %; internal high silver iodide type; diameter of equivalent sphere: 0.3 μm; coefficient of variation of diameter of equivalent sphere: 28%; mixture of regular crystals and twin crystals; diameter/thickness ratio: 2.5) | 0.3 (as silver) |
| ExS-4 | $5 \times 10^{-4}$ |
| ExS-6 | $0.3 \times 10^{-4}$ |
| ExS-5 | $2 \times 10^{-4}$ |
| Gelatin | 1.0 |
| ExM-9 | 0.2 |
| ExY-14 | 0.03 |
| ExM-8 | 0.03 |
| Solv-1 | 0.5 |
| **Eighth Layer: Second Green-Sensitive Emulsion Layer** | |
| Silver iodobromide emulsion (silver iodide: 4 mol %; internal high silver iodide type; diameter of equivalent sphere: 0.6 μm; coefficient of variation of diameter of equivalent sphere: 38%; mixture of regular crystals and twin crystals; diameter/thickness ratio: 4) | 0.4 (as silver) |
| Gelatin | 0.5 |
| ExS-4 | $5 \times 10^{-4}$ |
| ExS-5 | $2 \times 10^{-4}$ |
| ExS-6 | $0.3 \times 10^{-4}$ |
| ExM-9 | 0.25 |
| ExM-8 | 0.03 |
| ExM-10 | 0.015 |
| ExY-14 | 0.01 |
| Solv-1 | 0.2 |
| **Ninth Layer: Third Green Sensitive Emulsion Layer** | |
| Silver iodobromide emulsion (silver iodide: 6 mol %; internal high silver iodide type; diameter of equivalent sphere: 1.0 μm; coefficient of variation of diameter of equivalent sphere: 80%; mixture of regular crystals and twin crystals; diameter/thickness ratio: 1.2) | 0.85 (as silver) |
| Gelatin | 1.0 |
| ExS-7 | $3.5 \times 10^{-4}$ |
| ExS-8 | $1.4 \times 10^{-4}$ |
| ExM-11 | 0.01 |
| ExM-12 | 0.03 |
| ExM-13 | 0.20 |
| ExM-8 | 0.02 |
| ExY-15 | 0.02 |
| Solv-1 | 0.20 |
| Solv-2 | 0.05 |
| **Tenth Layer: Yellow Filter Layer** | |
| Gelatin | 1.2 |
| Yellow colloidal silver | 0.08 |
| Cpd-2 | 0.1 |
| Solv-1 | 0.3 |
| **Eleventh Layer: First Blue-Sensitive Emulsion Layer** | |
| Silver iodobromide emulsion (silver iodide: 4 mol %; internal high silver iodide type; diameter of equivalent sphere: 0.5 μm; coefficient of variation of diameter of equivalent sphere: 15%; octahedral grain) | 0.4 (as silver) |
| Gelatin | 1.0 |
| ExS-9 | $2 \times 10-4$ |
| ExY-16 | 0.9 |
| ExY-14 | 0.07 |
| Solv-1 | 0.2 |
| **Twelfth Layer: Second Blue-Sensitive Emulsion Layer** | |
| Silver iodobromide emulsion (silver iodide: 10 mol %; internal high silver iodide type; diameter of equivalent sphere: 1.3 μm; coefficient of variation of diameter of equivalent sphere: 25%; mixture of regular crystals and twin crystals; diameter/thickness ratio: 4.5) | 0.5 (as silver) |
| Gelatin | 0.6 |
| ExS-9 | $1 \times 10^{-4}$ |
| ExY-16 | 0.25 |
| Solv-1 | 0.07 |
| **Thirteenth Layer: First Protective Layer** | |
| Gelatin | 0.8 |
| UV-1 | 0.1 |
| UV-2 | 0.2 |
| Solv-1 | 0.01 |
| Solv-2 | 0.01 |
| **Fourteenth Layer: Second Protective Layer** | |
| Fine grain silver bromide (average particle size: 0.07 μm) | 0.5 |
| Gelatin | 0.45 |
| Polymethyl methacrylate particle (diameter: 1.5 μm) | 0.2 |
| H-1 | 0.4 |
| Cpd-3 | 0.5 |
| Cpd-4 | 0.5 |

A surface active agent was added to each of the layers as a coating aid in addition to the above described components. Thus, Sample 101 was prepared.

The chemical structural formulae or chemical names of the compounds employed in this example are shown below.

UV-1

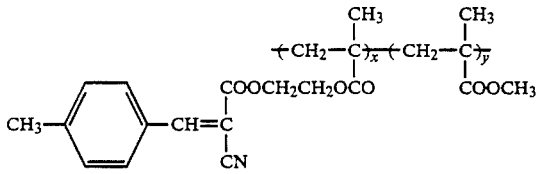

wherein x/y = 7/3 (in weight ratio)

-continued
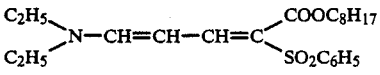
UV-2
Tricresyl phosphate — Solv-1
Dibutyl phthalate — Solv-2
Bis(2-ethylhexyl)phthalate — Solv-3
ExM-8
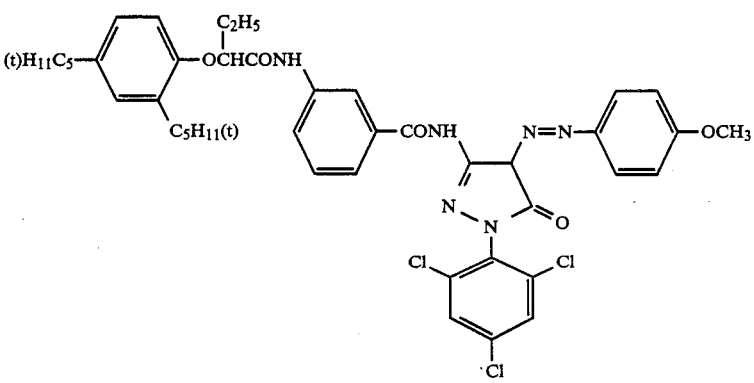
ExF-1
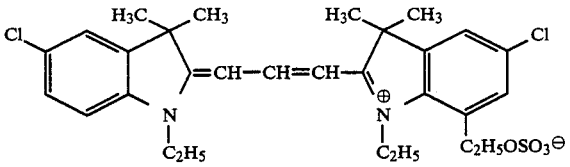
ExC-2
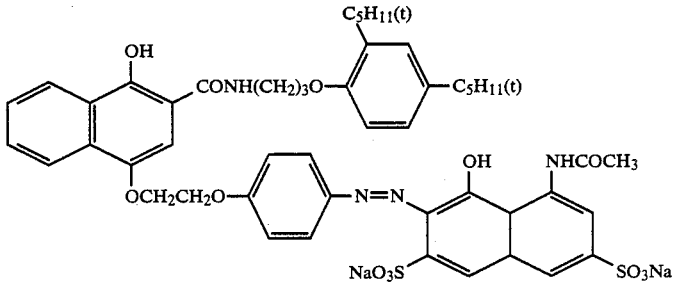
ExC-3
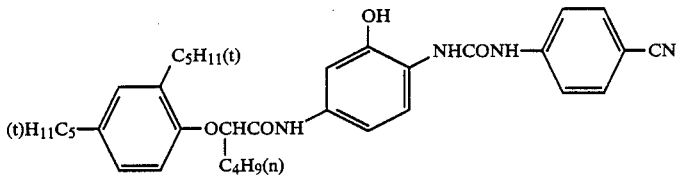
ExC-4
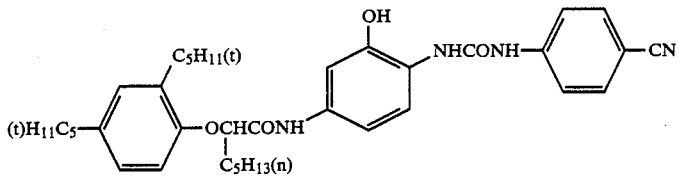

-continued
ExY-14
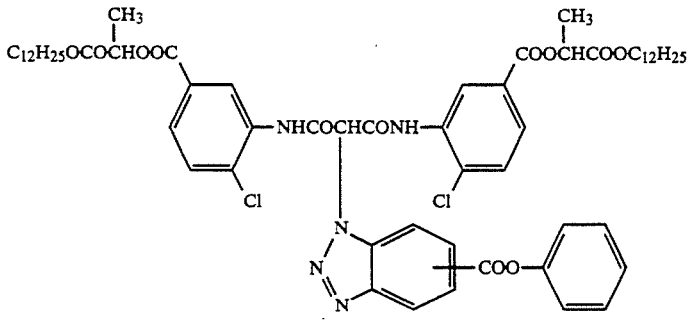
ExY-15
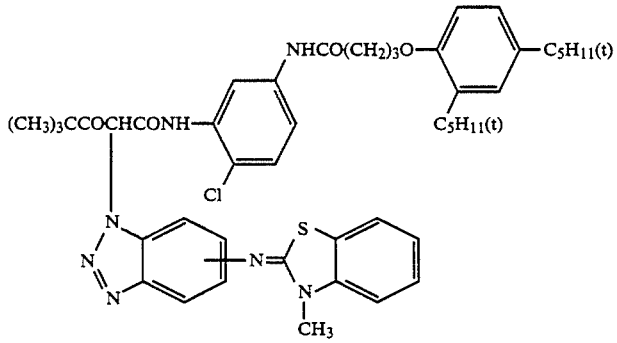
ExC-5
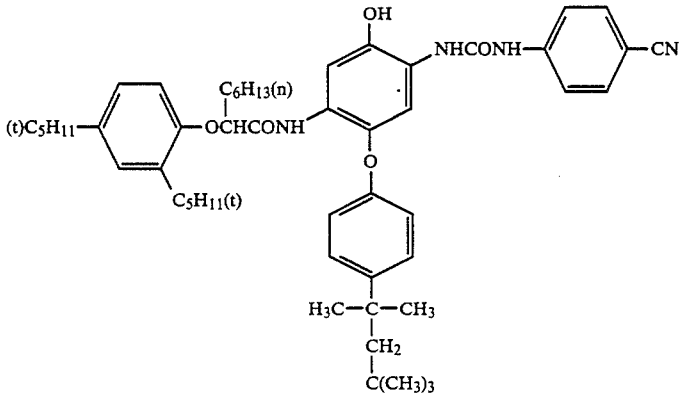
ExC-6
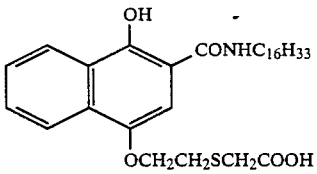
ExC-7
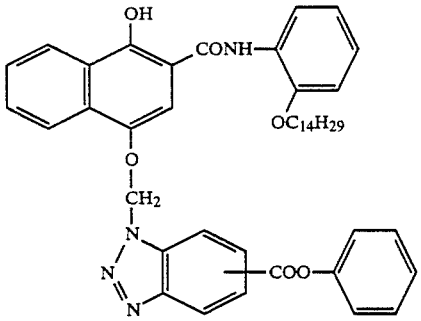

-continued
ExM-9
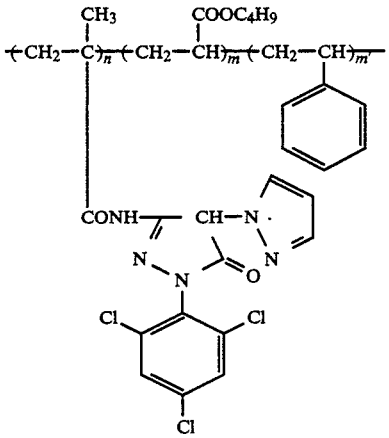
n = 50
m = 25
m' = 25
(mol. wt. about 20,000)
ExM-10
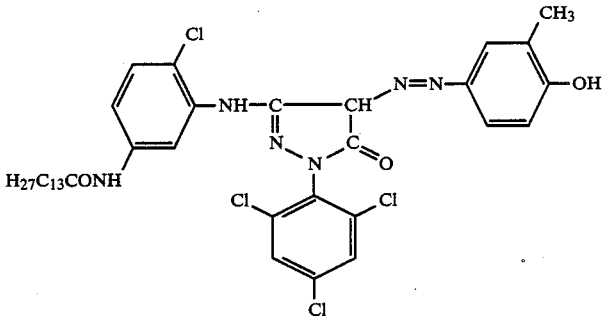
ExM-11
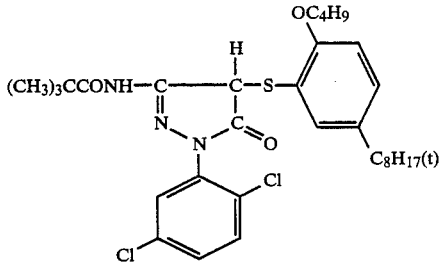
ExM-12
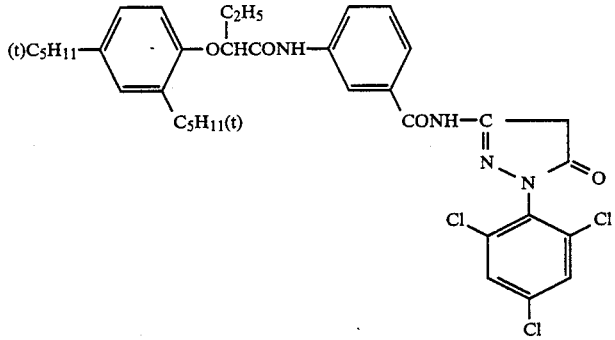

-continued
ExM-13
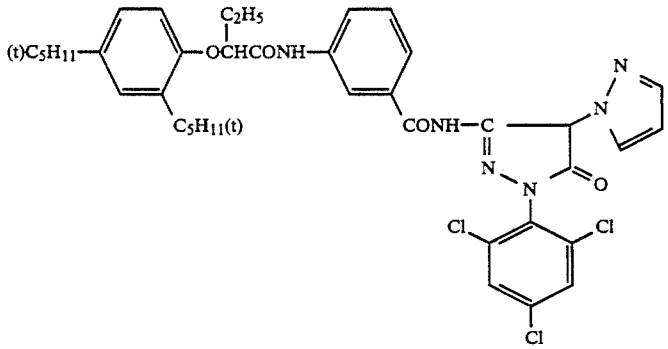
ExM-13
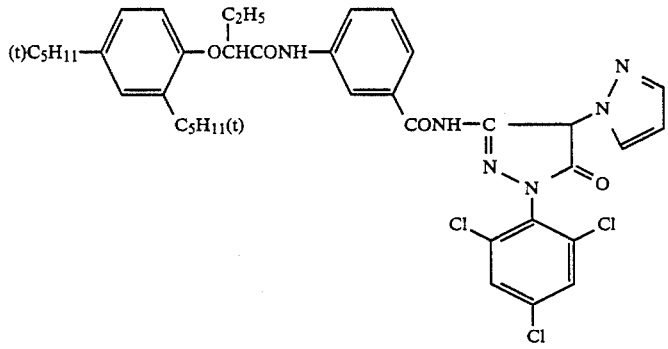
ExY-16
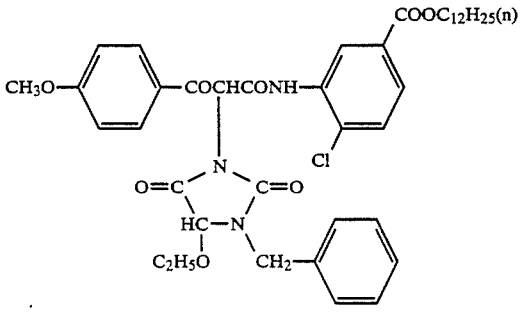
Cpd-1
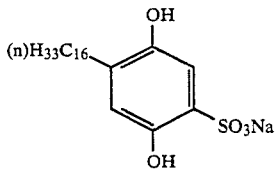
Cpd-2
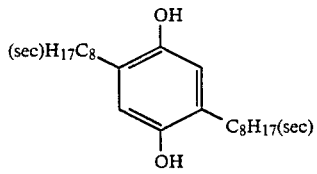
ExS-1
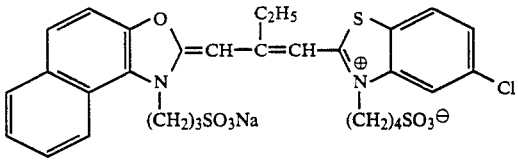

-continued
ExS-2
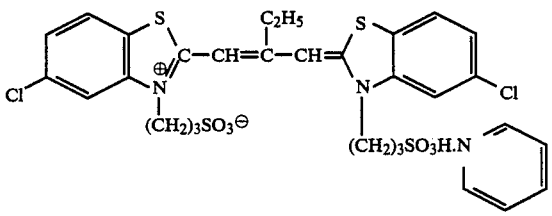
ExS-3
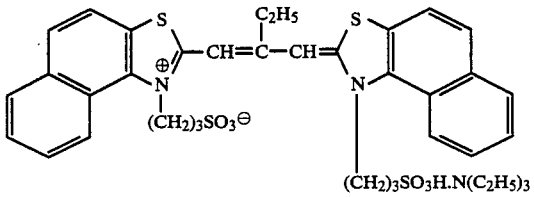
ExS-4
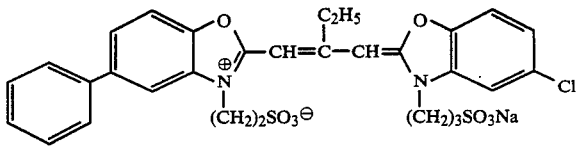
ExS-5
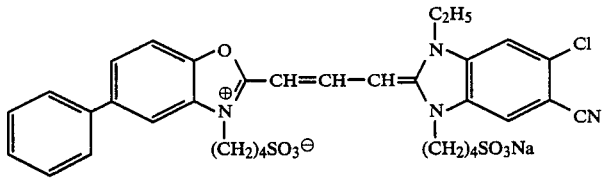
ExS-6
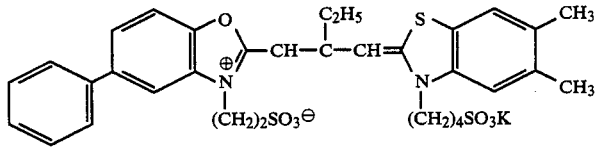
ExS-7
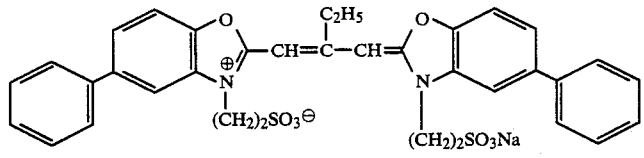
ExS-8
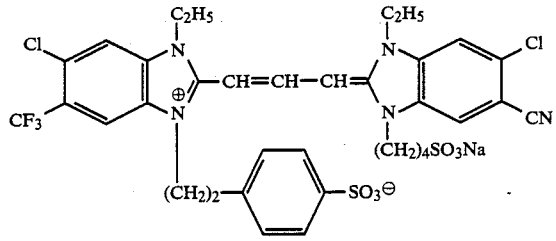
ExS-9
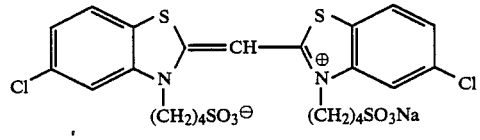
H-1
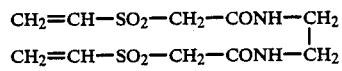

-continued

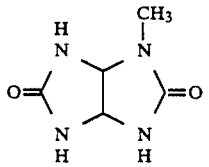

Cpd-3

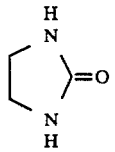

Cpd-4

Preparation of Samples 102 and 103

Samples 102 and 103 were prepared in the same manner as described for Sample 101 except using Comparative Compounds A and B in place of ExC-6 added to the fifth layer of Sample 101, respectively.

Preparation of Samples 104 and 114

Samples 104 to 114 were prepared in the same manner as described for Sample 101 except adding an equimolar amount (to ExC-6) of Comparative Compounds C, D and E and the compounds according to the present invention as shown in Table 1 below to the fifth layer of Sample 101, respectively.

Comparative Compound A:

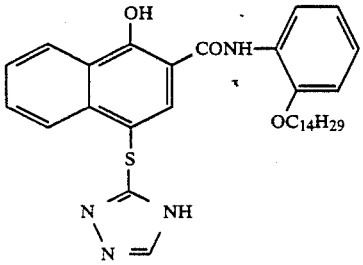

(the compound described in Research Disclosure, No. 11449 (1973))

Comparative Compound B:

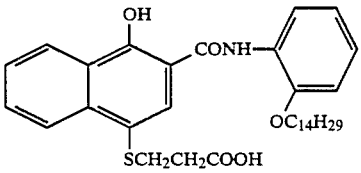

Comparative Compound C:

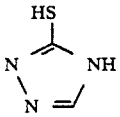

Comparative Compound D:

$HSCH_2CH_2COOH$

Comparative Compound E:

-continued

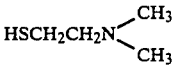

Samples 101 to 114 thus-obtained were cut into strips of 35 m/m width, used to photograph standard subjects and subjected to a running test according to Processing Step (I) for Comparison, or Processing Steps (II) or (III) of the present invention shown below with a 500 m length. After the running test, other strips of Samples 101 to 114 were exposed to white light of 20 CMS through a step wedge and then subjected to the development processing according to Processing Steps (I), (II) or (III) shown below.

The amount of remaining silver in the maximum density area of each sample thus-processed was determined according to X-ray fluorometric analysis. The results obtained are shown in Table 1 below.

Further, in order to determine stability during preservation of Samples 101 to 114 before exposure to light, each sample was stored under conditions of 45° C. and 80%RH for 1 week and then subjected to the wedge exposure and development processing according Processing Step (II) in the same manner as described above to evaluate changes in photographic characteristics. The results obtained are also shown in Table 1 below.

From these results shown in Table 1 below, it can be seen that the samples according to the present invention exhibited sufficiently high silver removal accelerating effect even in the running conditions and were excellent in stability during preservation. That is, in Processing Step (I) for comparison, the amount of remaining silver (i.e., a residual silver amount) was from $\frac{1}{4}$ to $\frac{1}{2}$ times as large as that of Sample 101 containing no bleach accelerating agent. However, in Processing Step (III) of the present invention, the amount of remaining silver was from $\frac{1}{8}$ to $\frac{1}{4}$ times as large as that of Sample 101. Accordingly, it is an unexpected effect that the effect of Processing Step (III) is larger than that of Processing Step (I) in which a bleaching treatment and a fixing treatment are separately carried out. Further, in Processing Step (II), the amount of remaining silver was from $\frac{1}{8}$ to $\frac{1}{3}$ times as large as that of Sample 101. That is, the time for remaining silver treatment (i.e., the time for desilvering) could be shortened from 7 minutes to 4 minutes and 15 seconds. Thus the amount of remaining silver of Samples 102 and 103 was large, and the variation of sensitivity of Samples 104 to 106 was large. However, the present invention had both of a good remaining silver property and a good stability of sensitivity.

On the other hand, each of Comparative Compounds C, D and E was added to the bleach-fixing solution of Processing Step (III). Using the bleach-fixing solution, Sample 101 was subjected to running processing and thereafter another strip of Sample 101 was subjected to wedge exposure and development processing in the same manner as described above to determine the amount of remaining silver. From the results, it is apparent that these comparative compounds exhibited only slight silver removal accelerating effect in comparison with the cases wherein the comparative compounds were not added to the bleach-fixing solution.

The sensitivities of the red-sensitive layer were almost same with Processing Steps (I), (II) and (III).

Furthermore, the bleach-fixing time was reduced from 3 min. 15 sec. to 2 min. in Processing Step (II) and the amount of remaining silver was evaluated in the same manner as described above. As a result, it can be seen that Samples 107 to 114 containing the compounds according to the present invention and Samples 104 to 106 for comparison exhibited almost the same amount of remaining silver, although the amount of remaining silver was about double in Samples 101 to 103.

Similar results were obtained when the bleaching time was reduced from 3 min. to 1 min. 30 sec. in Processing Step (I). That is, it is clearly seen that when comparative compounds A and B which are similar to the precursor type compound of the present invention were used, if the time for bleach-fixing treatment is shortened, the remaining silver property is reduced as compared with the use of compound of the present invention.

Processing Step (I): [Processing Temperature: 38° C.]

| Processing Step | Processing Time | Amount of Replenishment* |
|---|---|---|
| Color Development | 3 min. 15 sec. | 15 ml |
| Bleaching | 3 min. 00 sec. | 5 ml |
| Fixing | 4 min. 00 sec. | 30 ml |
| Stabilizing (1) | 30 sec. | — |
| Stabilizing (2) | 30 sec. | — |
| Stabilizing (3) | 30 sec. | 30 ml |
| Drying | 1 min. 30 sec. (at 50° C.) | — |

*Amount of replenishment per 1 meter of a 35 m/m width strip

In the above described processing steps, the stabilizing steps (1), (2) and (3) were carried out using a countercurrent stabilizing system of (3)→(2)→(1). Further, the amount of fixing solution carried over to the stabilizing tank was 2 ml per meter of the strip.

The composition of each processing solution used is illustrated below.

| Color Developing Solution: | Tank Solution | (Mother Liquor) | Replenisher |
|---|---|---|---|
| Diethylenetriaminepentaacetic Acid | 1.0 g | | 2.0 g |
| 1-Hydroxyethylidene-1,1-diphosphonic Acid | 2.0 g | | 3.3 g |
| Sodium Sulfite | 4.0 g | | 5.0 g |
| Potassium Carbonate | 30.0 g | | 38.0 g |
| Potassium Bromide | 1.4 g | | — |
| Potassium Iodide | 1.3 mg | | — |
| Hydroxylamine | 2.4 g | | 3.2 g |
| 4-(N-Ethyl-N-β-hydroxyethylamino)-2-methylaniline Sulfate | 4.5 g | | 7.2 g |
| Water to make | 1 l | | 1 l |

-continued

| pH | 10.00 | | 10.05 |
|---|---|---|---|
| Bleaching Solution: | Tank Solution | (Mother Liquor) | Replenisher |
| Ammonium Iron (III) Ethylenediaminetetraacetate | 50 g | | 60 g |
| Ammonium Iron (III) 1,3-Diaminopropanetetraacetate | 60 g | | 72 g |
| Aqueous Ammonia 27% (weight/volume) | 7 ml | | 5 ml |
| Ammonium Nitrate | 10.0 g | | 12.0 g |
| Ammonium Bromide | 150 g | | 170 g |
| Water to make | 1 l | | 1 l |
| pH | 6.0 | | 5.8 |
| Fixing Solution: | Tank Solution | (Mother Liquor) | Replenisher |
| Disodium Ethylenediaminetetraacetate | 1.0 g | | 1.2 g |
| Sodium Sulfite | 4.0 g | | 5.0 g |
| Sodium Bisulfite | 4.6 g | | 5.8 g |
| Ammonium Thiosulfate (700 g/l) | 175 ml | | 200 ml |
| Water to make | 1 l | | 1 l |
| pH | 6.6 | | 6.6 |
| Stabilizing Solution: | Tank Solution | (Mother Liquor) | Replenisher |
| Formalin (37% w/v) | 2.0 ml | | 3.0 ml |
| Polyoxyethylene-p-monononylphenylether (average degree of polymerization: 10) | 0.3 g | | 0.45 g |
| 5-Chloro-2-methyl-4-isothiazolin-3-one | 0.03 g | | 0.045 g |
| Water to make | 1 l | | 1 l |

Processing Step (II): [Processing Temperature: 38° C.]

| Processing Step | Processing Time | Amount of Replenishment* |
|---|---|---|
| Color Development | 3 min. 15 sec. | 15 ml |
| Bleaching | 1 min. 00 sec. | 10 ml |
| Bleach-Fixing | 3 min. 15 sec. | 15 ml |
| Washing with Water (1) | 40 sec. | — |
| Washing with Water (2) | 1 min. 00 sec. | 1200 ml |
| Stabilizing | 20 sec. | 15 ml |
| Drying | 1 min. 15 sec. (at 60° C.) | — |

*Amount of replenishment per 1 meter of a 35 m/m width strip

In the above described processing steps, the washing with water steps (1) and (2) were carried out using a countercurrent water washing system from Washing with Water (2) to Washing with Water (1).

The composition of each processing solution used is illustrated below.

| Color Developing Solution: | Tank Solution | (Mother Liquor) | Replenisher |
|---|---|---|---|
| Diethylenetriaminepentaacetic Acid | 1.0 g | | 1.1 g |
| 1-Hydroxyethylidene-1,1-diphosphonic Acid | 2.0 g | | 2.2 g |
| Sodium Sulfite | 4.0 g | | 4.9 g |
| Potassium Carbonate | 30.0 g | | 42.0 g |
| Potassium Bromide | 1.6 g | | — |
| Potassium Iodide | 2.0 mg | | — |
| Hydroxylamine | 2.4 g | | 3.6 g |
| 4-(N-Ethyl-N-β-hydroxyethylamino)-2-methylaniline Sulfate | 5.0 g | | 7.3 g |
| Water to make | 1 l | | 1 l |
| pH | 10.00 | | 10.05 |

(both Tank Solution (Mother

-continued

| Bleaching Solution: | Liquor) and Replenisher) |
|---|---|
| Ammonium Iron (III) Ethylenediaminetetraacetate | 120.0 g |
| Disodium Ethylenediaminetetraacetate | 10.0 g |
| Ammonium Nitrate | 10.0 g |
| Ammonium Bromide | 100.0 g |
| Adjusted pH to 6.3 with aqueous ammonia | |
| Water to make | 1 l |

| Bleach-Fixing Solution: | (both Tank Solution (Mother Liquor) and Replenisher) |
|---|---|
| Ammonium Iron (III) Ethylenediaminetetraacetate | 50.0 g |
| Disodium Ethylenediaminetetraacetate | 5.0 g |
| Sodium Sulfite | 12.0 g |
| Aqueous Solution of Ammonium Thiosulfate (700 g/l) | 240.0 ml |
| Adjusted pH to 7.3 with aqueous ammonia | |
| Water to make | 1 l |

Washing Water

City water which was passed through a column filled with an Na-type strong acidic cation exchange resin (Diaion SK-1B manufactured by Mitsubishi Chemical Industries Ltd.) to prepare water having a water quality of calcium: 2 mg/l and magnesium: 1.2 mg/l was employed.

Stabilizing Solution

Same as described in Processing Step (I).

Processing Step (III): [Processing Temperature: 38° C.]

| Processing Step | Processing Time | Capacity of Tank | Amount of Replenishment* |
|---|---|---|---|
| Color Development | 3 min. 15 sec. | 8 l | 15 ml |
| Bleach-Fixing | 2 min. 30 sec. | 8 l | 25 ml |
| Washing With Water (1) | 20 sec. | 4 l | |
| Washing With Water (2) | 20 sec. | 4 l | Three-stage countercurrent system |
| Washing With Water (3) | 20 sec. | 4 l | 10 ml |
| Stabilizing | 20 sec. | 4 l | 10 ml |

*Amount of replenishment per 1 meter of a 35 m/m width strip

In the above described processing steps, the washing with water steps (1), (2) and (3) were carried out using a three-stage countercurrent washing with water system of (3)→(2)→(1).

The composition of each processing solution used is illustrated below.

| Color Developing Solution | Tank Solution (Mother Liquor) | Replenisher |
|---|---|---|
| Diethylenetriaminepenta-acetic Acid | 1.0 g | 1.2 g |
| 1-Hydroxyethylidene-1,1-diphosphonic Acid | 2.0 g | 2.4 g |
| Sodium Sulfite | 2.0 g | 4.8 g |
| Potassium Carbonate | 35.0 g | 45.0 g |
| Potassium Bromide | 1.6 g | — |
| Potassium Iodide | 2.0 mg | — |
| Hydroxylamine | 2.0 g | 3.6 g |
| 4-(N-Ethyl-N-β-hydroxyethylamino)-2-methylaniline Sulfate | 5.0 g | 7.5 g |
| Water to make | 1 l | 1 l |
| Adjusted pH with potassium hydroxide to | 10.20 | 10.35 |

| Bleach-Fixing Solution: | Tank Solution (Mother Liquor) | Replenisher |
|---|---|---|
| Ammonium Iron (III) Ethylenediaminetetraacetate | 40 g | 45 g |
| Ammonium Iron (III) Diethylenetriaminepentaacetate | 40 g | 45 g |
| Disodium Ethylenediaminetetraacetate | 10 g | 10 g |
| Sodium Sulfite | 15 g | 20 g |
| Ammonium Thiosulfate (700 g/l aq. soln.) | 240 ml | 270 ml |
| Aqueous Ammonia (26 wt %) | 14 ml | 12 ml |
| Water to make | 1 l | 1 l |
| pH | 6.7 | 6.5 |

Washing Water

The following three kinds of washing water were employed.

| [1] City Water | |
|---|---|
| Calcium | 26 mg/l |
| Magnesium | 9 mg/l |
| pH | 7.2 |

[2] Ion Exchanged Water

The above described city water was treated with an Na-type strong acidic cation exchange resin manufactured by Mitsubishi Chemical Industries Ltd. to prepare water having the following water quality:

| | |
|---|---|
| Calcium | 1.1 mg/l |
| Magnesium | 0.5 mg/l |
| pH | 6.6 |

[3] City Water Containing Chelating Agent

To the above described city water, was added disodium ethylenediaminetetraacetate in an amount of 500 mg per liter.

| | |
|---|---|
| pH | 6.7 |

TABLE 1

| Sample No. | Compound Added to Fifth Layer | Amount of Remaining Silver: Processing Step (I) (mg/m²) | Processing Step (II) (mg/m²) | Processing Step (III) (mg/m²) | Sensitivity of* Red-Sensitive Layer | Decrease in Sensitivity** after Preservation at 45° C., 80% RH for 1 Week |
|---|---|---|---|---|---|---|
| 101 (Comparison) | none | 43 | 80 | 140 | ±0 | −0.03 |

TABLE 1-continued

| Sample No. | Compound Added to Fifth Layer | Amount of Remaining Silver: Processing Step (I) (mg/m²) | Processing Step (II) (mg/m²) | Processing Step (III) (mg/m²) | Sensitivity of* Red-Sensitive Layer | Decrease in Sensitivity** after Preservation at 45° C., 80% RH for 1 Week |
|---|---|---|---|---|---|---|
| 102 (Comparison) | A | 36 | 61 | 113 | +0.02 | −0.10 |
| 103 (Comparison) | B | 28 | 36 | 52 | +0.03 | −0.13 |
| 104 (Comparison) | C | 42 | 79 | 135 | −0.18 | −0.15 |
| 105 (Comparison) | D | 12 | 14 | 26 | −0.22 | −0.16 |
| 106 (Comparison) | E | 8 | 9 | 16 | −0.26 | −0.20 |
| 107 (Present Invention) | (8) | 11 | 12 | 22 | −0.02 | −0.02 |
| 108 (Present Invention) | (9) | 18 | 23 | 30 | −0.02 | −0.03 |
| 109 (Present Invention) | (21) | 16 | 20 | 28 | −0.01 | −0.04 |
| 110 (Present Invention) | (22) | 10 | 11 | 18 | −0.01 | −0.04 |
| 111 (Present Invention) | (26) | 11 | 11 | 17 | −0.02 | −0.03 |
| 112 (Present Invention) | (33) | 20 | 26 | 30 | −0.02 | −0.02 |
| 113 (Present Invention) | (10) | 18 | 24 | 28 | −0.01 | −0.03 |
| 114 (Present Invention) | (27) | 19 | 23 | 29 | −0.02 | −0.02 |

*log E at the point having density of fog +0.2. Sample 101 was used as standard. [Processing Step (III)]
**Difference between sensitivity of sample preserved at 45° C. and 80% RH for 1 week and sensitivity of sample preserved in a refrigerator, 5° C. for 1 week.

EXAMPLE 2

Sample 201

On a cellulose triacetate film support provided with a subbing layer was coated each layer having the composition set forth below to prepare a multilayer color photographic light-sensitive material which was designated as Sample 201.

With respect to the compositions of the layers, coated amounts of silver halide and colloidal silver are shown in g/m² units of silver, the coated amounts of couplers, additives and gelatin are shown in g/m² units, and the coated amounts of sensitizing dyes are shown as mol number per mol of silver halide present in the same layer.

| | |
|---|---|
| First Layer: Antihalation Layer | |
| Black colloidal silver | 0.2 |
| Gelatin | 1.3 |
| ExM-9 | 0.06 |
| UV-1 | 0.03 |
| UV-2 | 0.06 |
| UV-3 | 0.06 |
| Solv-1 | 0.15 |
| Solv-2 | 0.15 |
| Solv-3 | 0.05 |
| Second Layer: Interlayer | |
| Gelatin | 1.0 |

-continued

| | |
|---|---|
| UV-1 | 0.03 |
| ExC-4 | 0.02 |
| ExF-1 | 0.004 |
| Solv-1 | 0.1 |
| Solv-2 | 0.1 |
| Third Layer: Low-Sensitive Red-Sensitive Emulsion Layer | |
| Silver iodobromide emulsion (AgI: 4 mol %, uniform AgI type, diameter corresponding to sphere: 0.5 μm, coefficient of variation of diameter corresponding to sphere: 20%, tabular grain, diameter/thickness ratio: 3.0) | 1.2 g (as silver) |
| Silver iodobromide emulsion (AgI: 3 mol %, uniform AgI type, diameter corresponding to sphere: 0.3 μm, coefficient of variation of diameter corresponding to sphere: 15%, spherical grain, diameter/thickness ratio: 1.0) | 0.6 (as silver) |
| Gelatin | 1.0 |
| ExS-1 | $4 \times 10^{-4}$ |
| ExS-2 | $5 \times 10^{-4}$ |
| ExC-1 | 0.05 |
| ExC-2 | 0.50 |
| ExC-3 | 0.03 |
| ExC-4 | 0.12 |
| ExC-5 | 0.01 |
| Fourth Layer: High-Sensitive Red-sensitive Emulsion Layer | |
| Silver iodobromide emulsion (AgI: 6 mol %, internal high AgI type with core/shell ratio of 1/1, diameter corresponding to sphere: 0.7 μm, coefficient of | 0.7 (as silver) |

-continued

| | |
|---|---|
| variation of diameter corresponding to sphere: 15%, tabular grain, diameter/thickness ratio: 5.0) | |
| Gelatin | 1.0 |
| ExS-1 | $3 \times 10^{-4}$ |
| ExS-2 | $2.3 \times 10^{-5}$ |
| ExC-6 | 0.11 |
| ExC-7 | 0.05 |
| ExC-4 | 0.05 |
| Solv-1 | 0.05 |
| Solv-3 | 0.05 |
| Fifth Layer: Interlayer | |
| Gelatin | 0.5 |
| Cpd-1 | 0.1 |
| Solv-1 | 0.05 |
| Sixth Layer: Low-Sensitive Green-Sensitive Emulsion Layer | |
| Silver iodobromide emulsion (AgI: 4 mol %, surface high AgI type with core/shell ratio of 1/1, diameter corresponding to sphere: 0.5 μm, coefficient of variation of diameter corresponding to sphere: 15%, tabular grain, diameter/thickness ratio: 4.0) | 0.35 (as silver) |
| Silver iodobromide emulsion (AgI: 3 mol %, uniform AgI type, diameter corresponding to sphere: 0.3 μm, coefficient of variation of diameter corresponding to sphere: 25%, spherical grain, diameter/thickness ratio: 1.0) | 0.20 (as silver) |
| Gelatin | 1.0 |
| ExS-3 | $5 \times 10^{-4}$ |
| ExS-4 | $3 \times 10^{-4}$ |
| ExS-5 | $1 \times 10^{-4}$ |
| ExM-8 | 0.4 |
| ExM-9 | 0.07 |
| ExM-10 | 0.02 |
| ExY-11 | 0.03 |
| Solv-1 | 0.3 |
| Solv-4 | 0.05 |
| Seventh Layer: High-Sensitive Green-sensitive Emulsion Layer | |
| Silver iodobromide emulsion (AgI: 4 mol %, internal high AgI type with core/shell ratio of 1/3, diameter corresponding to sphere: 0.7 μm, coefficient of variation of diameter corresponding to sphere: 20%, tabular grain, diameter/thickness ratio: 5.0) | 0.8 (as silver) |
| Gelatin | 0.7 |
| ExS-3 | $5 \times 10^{-4}$ |
| ExS-4 | $3 \times 10^{-4}$ |
| ExS-5 | $1 \times 10^{-4}$ |
| ExM-8 | 0.1 |
| ExM-9 | 0.02 |
| ExY-11 | 0.03 |
| ExC-2 | 0.03 |
| ExM-14 | 0.01 |
| Solv-1 | 0.2 |
| Solv-4 | 0.01 |
| Eighth Layer: Interlayer | |
| Gelatin | 0.5 |
| Cpd-1 | 0.05 |
| Solv-1 | 0.02 |
| Ninth Layer: Donor Layer for Interimage Effect to Red-Sensitive Layer | |
| Silver iodobromide emulsion (AgI: 2 mol %, internal high AgI type with core/shell ratio of 2/1, diameter corresponding to sphere: 1.0 μm, coefficient of variation of diameter corresponding to sphere: 15%, tabular grain, diameter/thickness ratio: 6.0) | 0.35 (as silver) |
| Silver iodobromide emulsion (AgI: 2 mol %, internal high AgI type with core/shell ratio of 1/1, diameter corresponding to sphere: 0.4 μm, coefficient of variation of diameter corresponding to sphere: 20%, tabular grain, diameter/thickness ratio: 6.0) | 0.5 (as silver) |
| Gelatin | 0.5 |
| ExS-3 | $8 \times 10^{-4}$ |
| ExY-13 | 0.11 |
| ExM-12 | 0.03 |
| ExM-14 | 0.10 |
| Solv-1 | 0.20 |
| Tenth Layer: Yellow Filter Layer | |
| Yellow colloidal silver | 0.05 |
| Gelatin | 0.5 |
| Cpd-2 | 0.13 |
| Cpd-1 | 0.10 |
| Eleventh Layer: Low-Sensitive Blue-Sensitive Emulsion Layer | |
| Silver iodobromide emulsion (AgI: 4.5 mol %, uniform AgI type, diameter corresponding to sphere: 0.7 μm, coefficient of variation of diameter corresponding to sphere: 15%, tabular grain, diameter/thickness ratio: 7.0) | 0.3 (as silver) |
| Silver iodobromide emulsion (AgI: 3 mol %, uniform AgI type, diameter corresponding to sphere: 0.3 μm, coefficient of variation of diameter corresponding to sphere: 25%, tabular grain, diameter/thickness ratio: 7.0) | 0.15 (as silver) |
| Gelatin | 1.6 |
| ExS-6 | $2 \times 10^{-4}$ |
| ExC-16 | 0.05 |
| ExC-2 | 0.10 |
| ExC-3 | 0.02 |
| ExY-13 | 0.07 |
| ExY-15 | 0.5 |
| ExY-17 | 1.0 |
| Solv-1 | 0.20 |
| Twelfth Layer: High-Sensitive Blue-Sensitive Emulsion Layer | |
| Silver iodobromide emulsion (AgI: 10 mol %, internal high AgI type, diameter corresponding to sphere: 1.0 μm, coefficient of variation of diameter corresponding to sphere: 25%, multiple twin tabular grain, diameter/thickness ratio: 2.0) | 0.5 (as silver) |
| Gelatin | 0.5 |
| ExS-6 | $1 \times 10^{-4}$ |
| ExY-15 | 0.20 |
| ExY-13 | 0.01 |
| Solv-1 | 0.10 |
| Thirteenth Layer: First Protective Layer | |
| Gelatin | 0.8 |
| UV-4 | 0.1 |
| UV-5 | 0.15 |
| Solv-1 | 0.01 |
| Solv-2 | 0.01 |
| Fourteenth Layer: Second Protective Layer | |
| Fine grain silver iodobromide emulsion (AgI: 2 mol %, uniform AgI type, diameter corresponding to sphere: 0.07 μm) | 0.5 (as silver) |
| Gelatin | 0.45 |
| Polymethyl methacrylate particle (diameter: 1.5 μm) | 0.2 |
| H-1 | 0.4 |
| Cpd-3 | 0.5 |
| Cpd-4 | 0.5 |

Each layer described above further contained a stabilizer for emulsion (Cpd-3: 0.04 g/m$^2$) and a surface active agent (Cpd-4: 0.02 g/m$^2$) as a coating aid in addition to the above described compounds. Further, compounds (Cpd-5: 0.5 g/m$^2$, Cpd-6: 0.5 g/m$^2$) were added to each layer.

The compounds used for the preparation of Sample 201 are illustrated below.

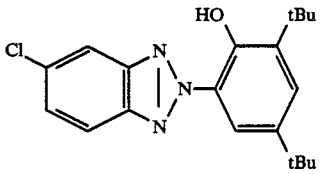
UV-1
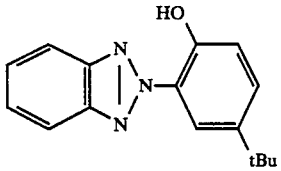
UV-2
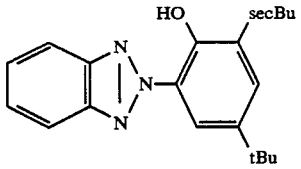
UV-3
Same as UV-1 in Example 1. UV-4
Same as UV-2 in Example 1. UV-5
Tricresyl phosphate Solv-1
Dibutyl phthalate Solv-2
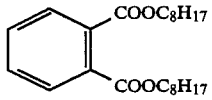
Solv-3
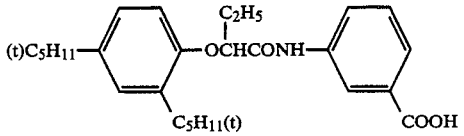
Solv-4
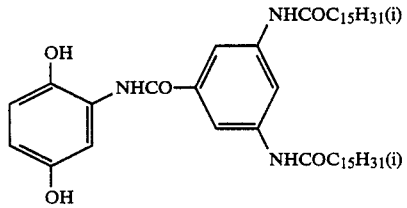
Cpd-1
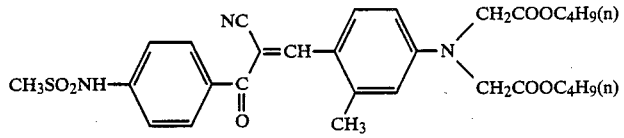
Cpd-2
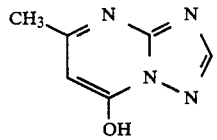
Cpd-3
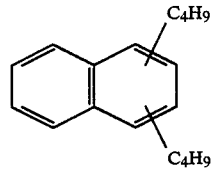
Cpd-4
Same as Cpd-3 in Example 1. Cpd-5

-continued
Same as Cpd-4 in Example 1. Cpd-6
Same as ExC-3 in Example 1. ExC-1
ExC-2
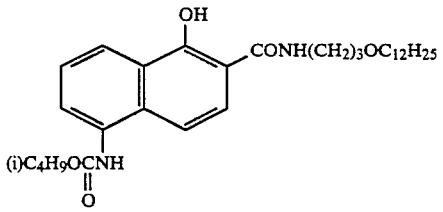
ExC-3
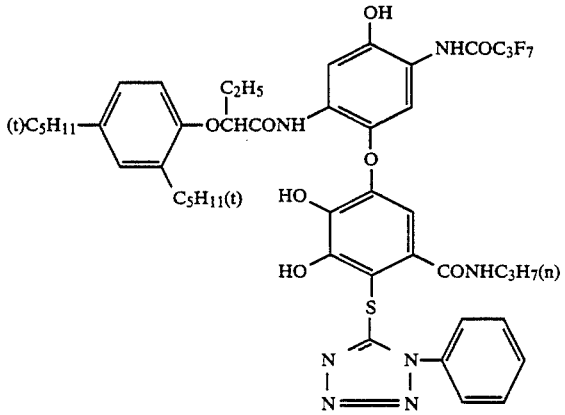
Same as ExC-2 in Example 1. ExC-4
Same as ExC-7 in Example 1. ExC-5
Same as ExC-5 in Example 1. ExC-6
ExC-7
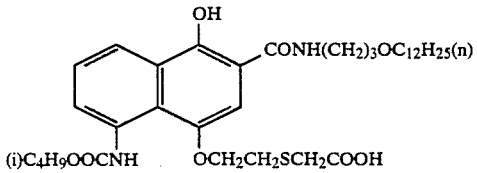
Same as ExM-9 in Example 1. ExM-8
ExM-9
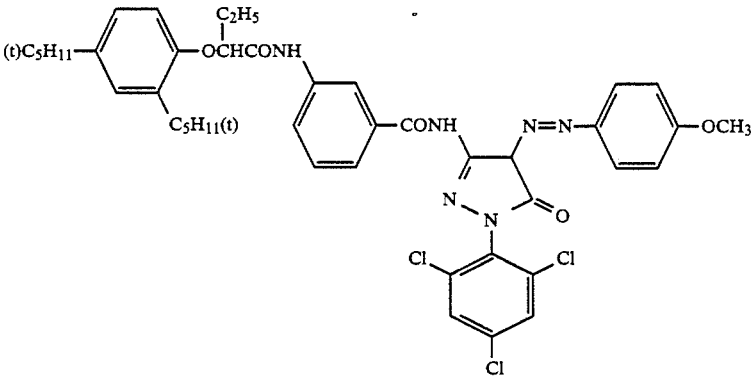
Same as ExM-10 in Example 1. ExM-10
Same as ExY-15 in Example 1. ExY-11

-continued
ExM-12
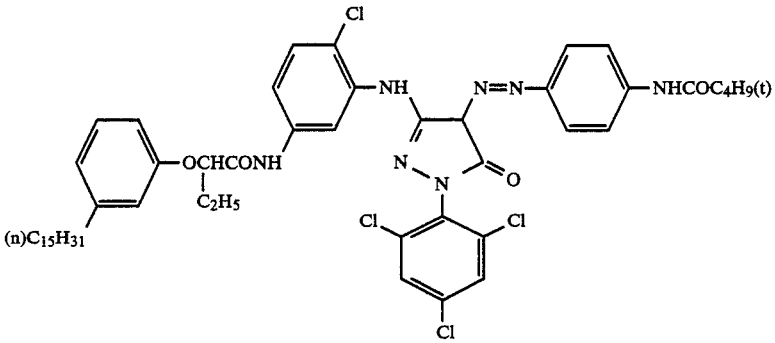
Same as ExY-14 in Example 1. ExY-13
Same as ExM-13 in Example 1. ExM-14
Same as ExY-16 in Example 1. ExY-15
Same as ExS-1 in Example 1. ExS-1
Same as ExS-2 in Example 1. ExS-2
ExS-3
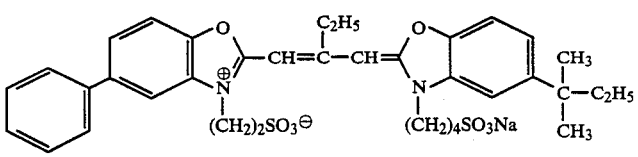
ExC-16
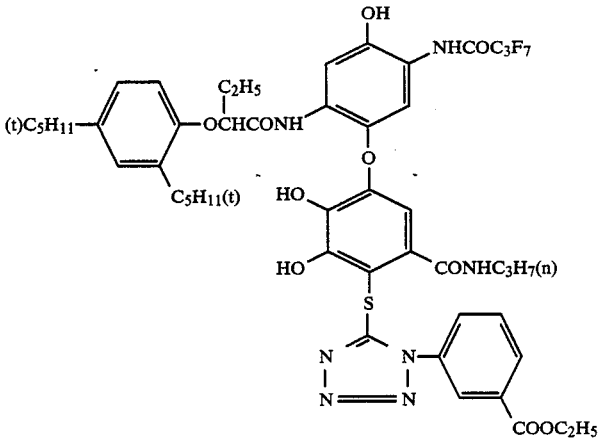
ExY-17
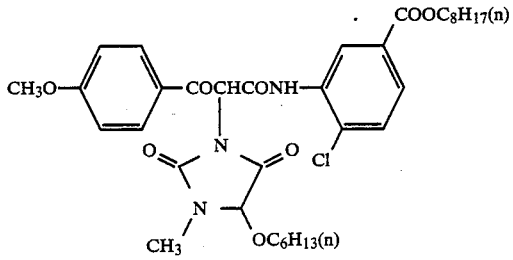
Same as ExS-4 in Example 1. ExS-4
Same as ExS-6 in Example 1. ExS-5
Same as ExS-9 in Example 1. ExS-6
Same as H-1 in Example 1. H-1
ExF-1
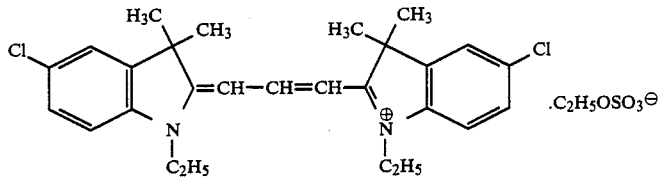

Samples 202 to 214

Samples 202 to 214 were prepared in the same manner as described for Sample 201 except adding the same compounds used in Samples 102 to 114 as described in Table 2 shown below to the second layer of Sample 201 in an amount of $2\times10^{-4}$ mol/m$^2$, respectively.

These samples thus prepared were subjected to the running processing according to Processing Step (III) in the same manner as described in Example 1. Then, other strips of these samples were subjected to the wedge exposure and development processing in the same manner as described in Example 1. After the processing, the amount of remaining silver in each sample was measured. The results obtained are shown in Table 2 below.

From the results shown in Table 2 below, it is apparent that the compounds according to the present invention exhibited sufficiently high silver removal accelerating effect when added to a light-insensitive interlayer.

TABLE 2

| Sample No. | Compound Added to Second Layer | Amount of Remaining Silver | Sensitivity of* Red-Sensitive Layer |
|---|---|---|---|
| 201 (Comparison) | none | 120 | ±0 |
| 202 (Comparison) | A | 100 | +0.01 |
| 203 (Comparison) | B | 90 | +0.01 |
| 204 (Comparison) | C | 46 | −0.03 |
| 205 (Comparison) | D | 18 | −0.21 |
| 206 (Comparison) | E | 15 | −0.25 |
| 207 (Present Invention) | (8) | 16 | ±0 |
| 208 (Present Invention) | (9) | 19 | −0.01 |
| 209 (Present Invention) | (21) | 20 | ±0 |
| 210 (Present Invention) | (22) | 16 | ±0 |
| 211 (Present Invention) | (26) | 14 | ±0 |
| 212 (Present Invention) | (33) | 21 | −0.01 |
| 213 (Present Invention) | (10) | 18 | ±0 |
| 214 (Present Invention) | (27) | 20 | −0.01 |

*Evaluated in the same manner as described in Example 1.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material comprising a support having thereon at least one of a silver halide emulsion layer comprising silver iodobromide containing from 2 to 25 mol % of silver iodide and other hydrophilic colloid layer, wherein the silver halide emulsion layer of other hydrophilic colloid layer contains at least one compound represented by formula (I):

$$A—B \qquad (I)$$

wherein A represents a blocking group capable of being cleaved from B during processing and B represents a bleach accelerating agent containing at least one hetero atom linked to A through the hetero atom, wherein said method comprises at least one color developing step and desilvering step comprising a bleach-fixing treatment, the time for the desilvering step being from 30 seconds to 3 minutes.

2. The method for processing a silver halide color photographic material as claimed in claim 1, wherein said compound represented by formula (I) is represented by formula (II):

$$AX_{(m_1)}D$$

wherein A has the same meaning as in formula (I); D represents a bleach accelerating agent containing at least one hetero atom and linked to $X_1$ or A through the hetero atom; $X_1$ represents a divalent linking group containing at least one hetero atom and linked to A through the hetero atom; and $m_1$ is 0 or 1.

3. The method for processing a silver halide color photographic material as claimed in claim 2, wherein D is a group represented by formulae (III) or (III'):

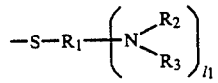

(III)

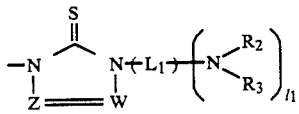

(III')

wherein $R_1$ represents a divalent, trivalent or tetravalent aliphatic group containing from 1 to 8 carbon atoms,

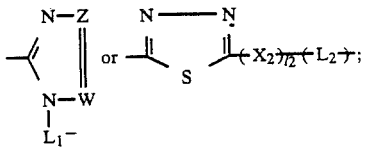

Z and W,
which may be the same or different, each represents $$—N= \text{ or } —\underset{\|}{C}—R_4;$$

$R_4$ represents a hydrogen, atom, a halogen atom, an amino group, a hydroxyl group, an alkenyl group, an aryl group or an aralkyl group; $l_1$ is 0, 1, 2, or 3; $L_1$ represents a hydrogen atom when $l_1$ is 0 and $L_1$ represents a divalent, trivalent or tetravalent aliphatic group containing from 1 to 8 carbon atoms when $l_1$ is 1, 2, or 3; $L_2$ represents a divalent, trivalent or tetravalent aliphatic group containing from 1 to 8 carbon atoms; $X_2$ represents

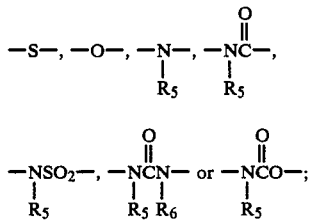

$R_5$ and $R_6$, which may be the same or different, each represents a hydrogen atom or a lower alkyl group; $l_2$ is 0 or 1; and $R_2$ and $R_3$, which may be the same or different, each represents a hydrogen atom, an alkyl group or an acyl group, and $R_2$ and $R_3$ may be linked to form a nitrogen-containing heterocyclic ring.

4. The method for processing a silver halide color photographic material as claimed in claim 2, wherein said compound represented by formula (II) is represented by formula (IV):

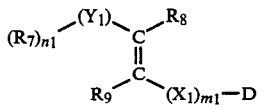

(IV)

wherein $R_7$, $R_8$ and $R_9$ which may be the same or different, each represents a hydrogen atom or a group that can be substituted, provided that $R_7$ and $R_8$ or $R_7$ and $R_9$ may be linked to form a carbocyclic ring or a heterocyclic ring; $n_1$ is 0 or 1; $Y_1$ represents

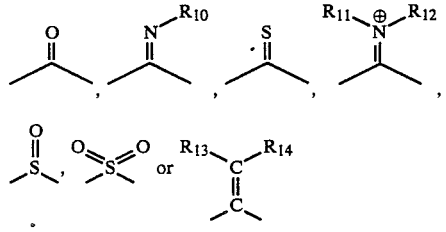

when n is 1, and $y_1$ represents a cyano group or a nitro group when n is 0; $R_{10}$, $R_{11}$, $R_{12}$, $R_{13}$ and $R_{14}$, which may be the same or different, each represents a hydrogen atom or a group that can be substituted; and $X_1$, $m_1$ and D each has the same meaning as in formula (II).

5. The method for processing a silver halide color photographic material as claimed in claim 4, wherein $R_{10}$, $R_{11}$, $R_{12}$, $R_{13}$ and $R_{14}$ each represents hydrogen, an alkyl group, an alkenyl group, an aryl group, an alkoxy group, an aryloxy group, an acyloxy group, an amino group, a carbonamide group, a ureido group, an oxycarbonyl group, a carbamoyl group, an acyl group, a sulfonyl group, a sulfinyl group, a sulfamoyl group, a cyano group or a nitro group.

6. The method for processing a silver halide color photographic material as claimed in claim 4, wherein said compound represented by formula (IV) is represented by formula (V) or (VI):

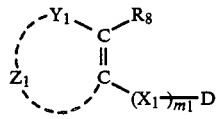

(V)

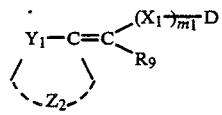

(VI)

wherein $Z_1$ and $Z_2$, which may be the same or different, each represents an atomic group necessary for forming a carbocyclic ring or a heterocyclic ring; and $R_8$ $R_9$, $X_1$, $Y_1$, D and $m_1$ each has the same meaning as in formula (IV).

7. The method for processing a silver halide color photographic material as claimed in claim 1, wherein said compound represented by formula (I) is present in an amount of from 0.01 mol % to 100 mol % based on the total amount of silver in said material.

8. The method for processing a silver halide color photographic material as claimed in claim 1, wherein said compound represented by formula (I) is present in a light-insensitive layer.

9. The method for processing a silver halide color photographic material as claimed in claim 8, wherein the group that can be substituted represented by $R_8$ and $R_9$ each represents a halogen atom, an alkyl group, an aryl group, an alkoxy group, an aryloxy group, an alkylthio group, an arylthio group, an acyloxy group, an amino group, a carbonamide group, a ureido group, a carboxyl group, a carbonic acid ester group, an oxycarbonyl group, a carbamoyl group, an acyl group, a sulfo group, s sulfonyl group, a sulfinyl group, a sulfamoyl group, a cyano group or a nitro group.

10. The method for processing a silver halide color photographic material as claimed in claim 6, wherein the carbocyclic ring represents a 5-membered, 6-membered or 7-membered ring, and the heterocyclic ring represents a 5-membered, 6-membered or 7-membered heterocyclic ring containing one or more nitrogen atoms, oxygen atoms or sulfur atoms.

11. The method for processing a silver halide color photographic material as claimed in claim 10, wherein the carbocyclic ring and the heterocyclic ring each has one or more substituents.

* * * * *